US009840078B2

(12) United States Patent
Takekoshi et al.

(10) Patent No.: US 9,840,078 B2
(45) Date of Patent: Dec. 12, 2017

(54) WASTE LIQUID RESERVOIR AND LIQUID EJECTING APPARATUS

(71) Applicant: SEIKO EPSON CORPORATION, Tokyo (JP)

(72) Inventors: Taro Takekoshi, Shiojiri (JP); Yusuke Hirasawa, Matsumoto (JP); Hidenori Tanaka, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/399,909

(22) Filed: Jan. 6, 2017

(65) Prior Publication Data

US 2017/0203572 A1 Jul. 20, 2017

(30) Foreign Application Priority Data

Jan. 18, 2016 (JP) ..... 2016-007093
Sep. 6, 2016 (JP) ..... 2016-173390

(51) Int. Cl.
*B41J 2/165* (2006.01)
*B41J 2/17* (2006.01)

(52) U.S. Cl.
CPC ..... *B41J 2/16517* (2013.01); *B41J 2/1721* (2013.01); *B41J 2002/1728* (2013.01)

(58) Field of Classification Search
CPC ..... B41J 2/1721; B41J 2002/1728
See application file for complete search history.

(56) References Cited

U.S. PATENT DOCUMENTS

2004/0051755 A1 3/2004 Kanamitsu et al.
2009/0218270 A1* 9/2009 Harada ..... B41J 2/1721 210/236
2009/0218271 A1* 9/2009 Harada ..... B41J 2/16523 210/236
2009/0219337 A1* 9/2009 Harada ..... B41J 2/1721 347/36
2009/0219338 A1* 9/2009 Harada ..... B41J 2/1721 347/36
2009/0219339 A1* 9/2009 Harada ..... B41J 2/1721 347/36
2012/0218348 A1* 8/2012 Okamoto ..... B41J 2/16508 347/36
2012/0236074 A1* 9/2012 Harada ..... B41J 2/1721 347/36
2015/0375509 A1* 12/2015 Harada ..... B41J 2/16517 347/36

FOREIGN PATENT DOCUMENTS

JP 2004-009700 1/2004
JP 2004-042442 2/2004
JP 2007-160870 6/2007

* cited by examiner

*Primary Examiner* — Julian Huffman
(74) *Attorney, Agent, or Firm* — Workman Nydegger

(57) ABSTRACT

A liquid ejecting apparatus includes a liquid ejecting head configured to eject liquid onto a medium, a mounting portion on which a liquid collection container including an absorber that absorbs liquid is removably mounted, a liquid receiving portion configured to receive the liquid ejected by the liquid ejecting head, and a relay portion located in a region communicating with the liquid receiving portion. The relay portion is located at a position in contact with the absorber of the liquid collection container mounted in the mounting portion.

7 Claims, 19 Drawing Sheets

WASTE LIQUID RESERVOIR AND LIQUID EJECTING APPARATUS

BACKGROUND

1. Technical Field

The present invention relates to a waste liquid reservoir that stores waste liquid, and a liquid ejecting apparatus in which the waste liquid reservoir is mounted.

2. Related Art

Examples of existing liquid ejecting apparatuses include an ink jet printer configured to perform borderless printing by ejecting ink droplets through nozzles provided in a liquid ejecting head onto a sheet, so as to apply the ink droplets all over the sheet without leaving a margin. When such borderless printing is performed, groove holes are formed in a platen supporting the sheet and a waste liquid tray is provided under the platen, so as to receive the ink droplets that have protruded from the edge of the sheet into an absorber located in the groove hole and introduce the ink received by the absorber into the waste liquid tray, for example as disclosed in JP-A-2004-9700.

The waste liquid can be properly introduced into the waste liquid tray by placing an ink absorber in the waste liquid tray and keeping the absorber in the groove hole in contact with the ink. However, in particular when the waste liquid tray is removably mounted, the absorber is displaced by the removal and mounting of the waste liquid tray, which disables the absorber in the groove hole from contacting the ink absorber of the newly mounted waste liquid tray.

The mentioned drawback is incidental, not only to printers that eject ink for printing, but generally to liquid ejecting apparatuses in which a liquid collection container for collecting ejected liquid is removably mounted.

SUMMARY

An advantage of some aspects of the invention is to provide a liquid ejecting apparatus configured to properly introduce liquid into a liquid collection container removably mounted in the liquid ejecting apparatus.

Hereunder, configurations of the liquid ejecting apparatus and advantageous effects thereby provided will be described.

In an aspect, the invention provides a liquid ejecting apparatus includes a liquid ejecting head configured to eject liquid onto a medium, a mounting portion on which a liquid collection container including an absorber that absorbs liquid is removably mounted, a liquid receiving portion configured to receive the liquid ejected by the liquid ejecting head, and a relay portion located in a region communicating with the liquid receiving portion. The relay portion is located at a position in contact with the absorber of the liquid collection container mounted in the mounting portion.

In the foregoing configuration, the relay portion is located in the region communicating with the liquid receiving portion. Therefore, the liquid received by the liquid receiving portion can be transferred to the relay portion. In addition, the relay portion is located at a position in contact with the absorber of the liquid collection container, and therefore the liquid received by the liquid receiving portion can be absorbed by the absorber of the liquid collection container, through the relay portion. Consequently, the liquid can be properly introduced into the liquid collection container which is removably mounted.

The liquid ejecting apparatus may further include a liquid absorber that absorbs the liquid received by the liquid receiving portion, and the liquid absorber may include a main body located in the liquid receiving portion and a liquid guide portion extending from the main body. The relay portion may be located in contact with the liquid guide portion.

With the mentioned configuration, the liquid received by the liquid receiving portion can be prevented from splashing around, because the main body of the liquid absorber is accommodated in the liquid receiving portion. In addition, the liquid received by the liquid receiving portion can be transferred to the relay portion through the liquid guide portion extending from the main body of the liquid absorber, while suppressing the splashing of the liquid.

In the liquid ejecting apparatus, at least a portion in contact with the absorber and a portion in contact with the liquid absorber in the relay portion may be formed by an osmotic transfer material capable of absorbing liquid utilizing capillary force.

With the mentioned configuration, the liquid absorbed into the liquid absorber in the liquid receiving portion can be transferred toward the liquid collection container with the capillary force of the osmotic transfer material provided in the relay portion. In addition, causing the osmotic transfer material to absorb the liquid enables prevention of the splashing of the liquid, in the process of introducing the liquid into the liquid collection container.

In the liquid ejecting apparatus, the relay portion may be located at a position subjected to pressing force of the absorber, by being set in contact with the absorber of the liquid collection container mounted in the mounting portion.

Setting thus the relay portion at the position subjected to the pressure of the absorber assures that the relay portion and the absorber make contact with each other, even though the position of the relay portion or the absorber is shifted owing to a production error or deformation originating from the liquid absorption.

The liquid ejecting apparatus may further include a medium support unit located in a region onto which the liquid ejecting head ejects the liquid, and the medium support unit may include the liquid receiving portion and a support projection protruding with respect to the liquid receiving portion, so as to support the medium.

With the mentioned configuration, since the medium support unit includes the liquid receiving portion and the support projection, the liquid that has protruded from the medium supported by the support projection can be received by the liquid receiving portion.

In the liquid ejecting apparatus, the relay portion may include a rotatable roller located such that an outer circumferential surface thereof protrudes into inside the mounting portion.

With the mentioned configuration, since the outer circumferential surface of the roller of the relay portion protrudes into inside the mounting portion, bringing the roller into contact with the absorber in the liquid collection container mounted in the mounting portion allows the liquid to be introduced into the liquid collection container through the relay portion.

In the liquid ejecting apparatus, the liquid collection container may be mounted in the mounting portion by being moved in a mounting direction, and an axial direction of a rotation shaft of the roller may be oriented so as to intersect the mounting direction.

With the mentioned configuration, when the liquid collection container is mounted in the mounting portion, the roller having the rotation shaft oriented so as to intersect the mounting direction of the liquid collection container rotates, thereby reducing sliding resistance between the relay portion and the absorber. Therefore, the relay portion can be brought into contact with the absorber without disturbing the mounting operation of the liquid collection container.

In another aspect, the invention provides a waste liquid reservoir to be removably mounted in a mounting chamber in a liquid ejecting apparatus that includes a liquid ejecting head that ejects liquid, a waste liquid receiving portion that receives the liquid ejected by the liquid ejecting head as waste liquid, a discharge unit that discharges the liquid discharged from the liquid ejecting head as waste liquid, a substrate connection unit, and the mounting chamber accommodating therein the discharge unit and the substrate connection unit. The waste liquid reservoir includes a waste liquid storage container including a sidewall and a bottom plate defining a waste liquid storage chamber that stores the waste liquid, the waste liquid storage chamber including a waste liquid inlet, located in a ceiling portion of the waste liquid storage chamber and opened toward an insertion direction so as to allow the waste liquid received by the waste liquid receiving portion to be introduced, when the waste liquid reservoir enters the mounting chamber by being moved in the insertion direction, a waste liquid introduction port to be connected to the discharge unit by being moved in the mounting chamber in a connection direction different from the insertion direction, and a circuit board including a connection terminal to be electrically connected to the substrate connection unit by being moved in the connection direction in the mounting chamber. The waste liquid introduction port is located in a front wall of the waste liquid storage container intersecting the sidewall and the bottom plate, and the connection terminal is located in the sidewall of the waste liquid storage container different from the front wall and the ceiling portion.

With the mentioned configuration, the connection terminal of the circuit board is located in the sidewall of the waste liquid storage container, different from the ceiling portion where the waste liquid inlet is provided and the front wall where the waste liquid introduction port is provided. Therefore, the waste liquid can be prevented from sticking to the connection terminal.

In the waste liquid reservoir, the waste liquid storage container may include a plurality of the waste liquid inlets aligned in the connection direction.

Aligning thus the plurality of waste liquid inlets in the connection direction allows the waste liquid to be evenly stored in the waste liquid storage container.

In the waste liquid reservoir, the mounting chamber may include a detent portion that detains the waste liquid storage container, the waste liquid storage container may include an engaging portion to be engaged with the detent portion when the waste liquid reservoir moves in the connection direction in the mounting chamber, the engaging portion being located in the ceiling portion, and the connection terminal may be located between the bottom plate and the engaging portion, in the waste liquid storage container.

With the mentioned configuration, the waste liquid storage container is restricted from moving in the connection direction, when the engaging portion is engaged with the detent portion. In addition, even when the waste liquid storage container, restricted from moving, is tilted about the engaging portion, the connection terminal is barely displaced because of being located between the bottom plate and the engaging portion. Therefore, defective contact of the connection terminal with the substrate connection unit can be prevented.

In the waste liquid reservoir, the mounting chamber may include a guide projection projecting in the connection direction, the waste liquid storage container may include a fitting portion to be engaged with the guide projection when the waste liquid reservoir moves in the connection direction, and the waste liquid introduction port may be located between the fitting portion and the engaging portion in a width direction that is an extending direction of the bottom plate and the front wall of the waste liquid storage container.

With the mentioned configuration, the waste liquid storage container is positioned in the mounting chamber by the fitting portion being engaged with the guide projection, when moving in the connection direction. Therefore, locating the waste liquid introduction port between the fitting portion and the engaging portion, which serve as reference for positioning, allows the waste liquid introduction port to be properly connected to the discharge unit.

In the waste liquid reservoir, the mounting chamber may include a guide projection projecting in the connection direction, the waste liquid storage container may include a fitting portion to be engaged with the guide projection when the waste liquid reservoir moves in the connection direction, and the waste liquid introduction port, the connection terminal, and the fitting portion may be located in the waste liquid storage container at positions overlapping an imaginary plane extending along the bottom plate.

With the mentioned configuration, the waste liquid storage container is positioned in the mounting chamber by the fitting portion being engaged with the guide projection, when moving in the connection direction. Therefore, locating the waste liquid introduction port and the connection terminal on the same imaginary plane on which the fitting portion is located allows the waste liquid introduction port and the connection terminal to be properly connected to the discharge unit and the substrate connection unit, respectively.

The waste liquid reservoir may further include a waste liquid transfer portion extending from the waste liquid receiving portion and projecting into the mounting chamber, and an absorber capable of absorbing the waste liquid stored in the waste liquid storage chamber. The absorber may enter into contact with the waste liquid transfer portion by being moved in the connection direction in the mounting chamber.

With the mentioned configuration, bringing the absorber into contact with the waste liquid transfer portion allows the waste liquid received by the waste liquid receiving portion to flow along the waste liquid transfer portion to reach the waste liquid storage chamber, thus to be absorbed by the absorber. Such an arrangement suppresses the waste liquid introduced through the waste liquid inlet from splashing around, thereby preventing the waste liquid from sticking to the connection terminal and the substrate connection unit.

In still another aspect, the invention provides a liquid ejecting apparatus including a liquid ejecting head that ejects liquid, a waste liquid receiving portion that receives the liquid ejected by the liquid ejecting head as waste liquid, a discharge unit that discharges the liquid discharged from the liquid ejecting head as waste liquid, a substrate connection unit, and a mounting chamber accommodating therein the discharge unit and the substrate connection unit. The waste liquid reservoir is removably mounted in the mounting chamber.

The mentioned configuration suppresses the waste liquid from sticking to the connection terminal and the substrate connection unit of the waste liquid reservoir mounted in the mounting chamber. Therefore, defective connection between the connection terminal and the substrate connection unit, originating from the sticking of the waste liquid, can be prevented.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereafter, embodiments of the liquid ejecting apparatus will be described with reference to the drawings. The liquid ejecting apparatus is herein exemplified by an ink jet printer that ejects ink, an example of the liquid, onto a medium such as a paper sheet, to thereby record (print) images thereon.

First Embodiment

Figure 1:
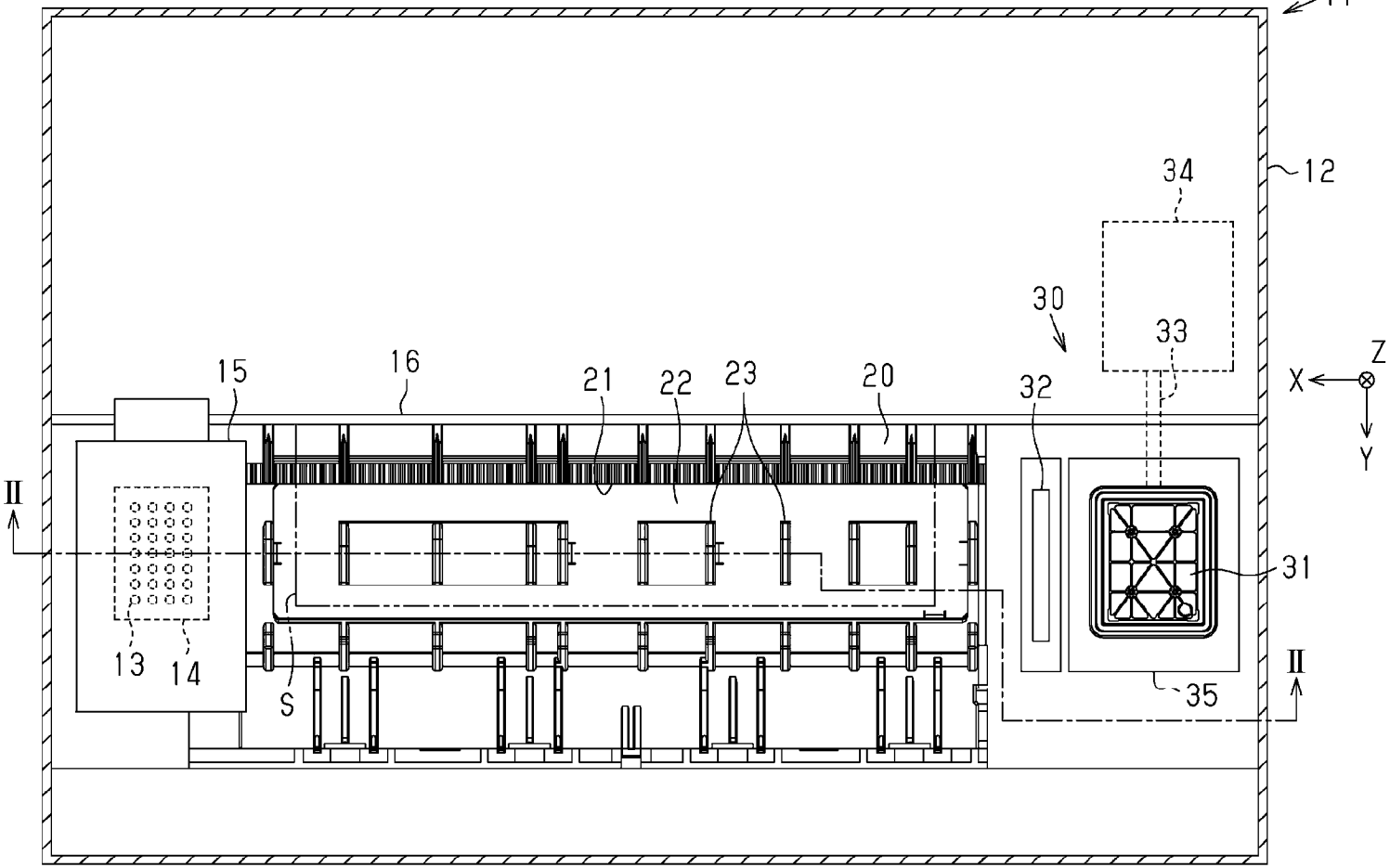
FIG. 1 is a schematic cross-sectional view showing a configuration of a liquid ejecting apparatus according to a first embodiment.

Referring to FIG. 1, the liquid ejecting apparatus 11 includes a casing 12 of a rectangular block box shape, a medium support unit 20 that supports a medium S, a liquid ejecting head 14 having a plurality of nozzles 13 through which liquid is ejected in a form of droplets onto the medium S, a carriage 15 carrying the liquid ejecting head 14 and set to reciprocate, and a guide shaft 16 that guides the movement of the carriage 15. The medium support unit 20 is located in a region onto which the liquid ejecting head 14 ejects the liquid.

In this embodiment, a direction in which the liquid ejecting head 14 ejects the liquid will be defined as ejection direction Z, a direction in which the medium S is transported on the medium support unit 20 will be defined as transport direction Y, and a forward moving direction of the liquid ejecting head 14 will be defined as moving direction X. In this embodiment, the ejection direction Z corresponds to a vertical direction (gravity direction), and the ejection direction Z, the transport direction Y, and the moving direction X intersect (preferably orthogonally) each other. The liquid ejecting apparatus 11 performs printing (recording) by causing the liquid ejecting head 14 to eject the liquid through the nozzles 13, onto the medium S supported by the medium support unit 20.

The liquid ejecting apparatus 11 includes a maintenance mechanism 30 for maintaining the ejection characteristics of the liquid ejecting head 14 in a good condition, the maintenance mechanism 30 being located on an starting end of the liquid ejecting head 14 in the moving direction X (on the right in FIG. 1).

The medium support unit 20 and the maintenance mechanism 30 are aligned along the moving direction X of the liquid ejecting head 14. The maintenance mechanism 30 includes a cap 31 located on the starting end side in the moving direction X, a wiper 32 located between the cap 31 and the medium support unit 20 in the moving direction X, a suction tube 33 connected to the cap 31, and a suction pump 34 provided halfway of the suction tube 33.

In this embodiment, the position in the travel range of the liquid ejecting head 14 in the moving direction X where the cap 31 is located will be referred to as home position of the liquid ejecting head 14, and the starting end side in the moving direction X (on the right in FIG. 1) will be referred to as home side. The terminal end side in the moving direction X (on the left in FIG. 1) will be referred to as opposite side of home.

The cap 31 can be moved by a moving mechanism 35 between a retracted position spaced from the liquid ejecting head 14 located at the home position (see FIG. 2) and a capping position where the cap 31 is in contact with the liquid ejecting head 14 so as to surround the nozzles 13.

The cap 31 defines, when located at the capping position, a closed space having openings through the nozzles 13. Forming thus the closed space having the openings provided by the nozzles 13 with the cap 31 will be referred to as "capping". When the cap 31 moves from the capping position to the retracted position, the capping is cancelled.

When the liquid is not ejected, for example while the power is off, the liquid ejecting head 14 is set at the home position and the cap 31 is set at the capping position to perform the capping, so as to prevent the nozzles 13 from drying.

The medium support unit 20 includes a liquid receiving portion 21 of a recessed shape and support projections 23 protruding with respect to the liquid receiving portion 21 so as to support the medium S. A plurality of support projections 23 may be aligned both in the moving direction X and in the transport direction Y. It is preferable to place in the liquid receiving portion 21 a liquid absorber 22 capable of absorbing the liquid thereby received.

Whereas the liquid ejecting apparatus 11 according to this embodiment is configured to perform the printing on a plurality of types of medium S different in size (length in the moving direction X and the transport direction Y) from each other, the medium S is transported with a lateral edge running along the opposite side of home irrespective of the size, so that the end portions of the medium S in the moving direction X are located above the liquid absorber 22.

Accordingly, in the case of performing borderless printing by applying the liquid droplets all over the medium S without leaving a margin, the liquid that has not landed on the medium S supported by the support projection 23 after being ejected by the liquid ejecting head 14 is received by the liquid receiving portion 21. In other words, the liquid receiving portion 21 is configured to receive the liquid ejected by the liquid ejecting head 14 but protruding from the medium S, in the case of borderless printing.

The liquid ejecting head 14 may be configured to perform preliminary dispensing (also referred to as flushing) including dispensing away the liquid unrelated to the printing job, before or after a printing operation, onto the liquid receiving portion 21 or the cap 31 located at the retracted position, to remove or prevent clogging of the nozzles 13. Thus, the liquid receiving portion 21 receives the liquid that has protruded from the medium S in the borderless printing, as well as the liquid dispensed away in the flushing operation.

Figure 2:
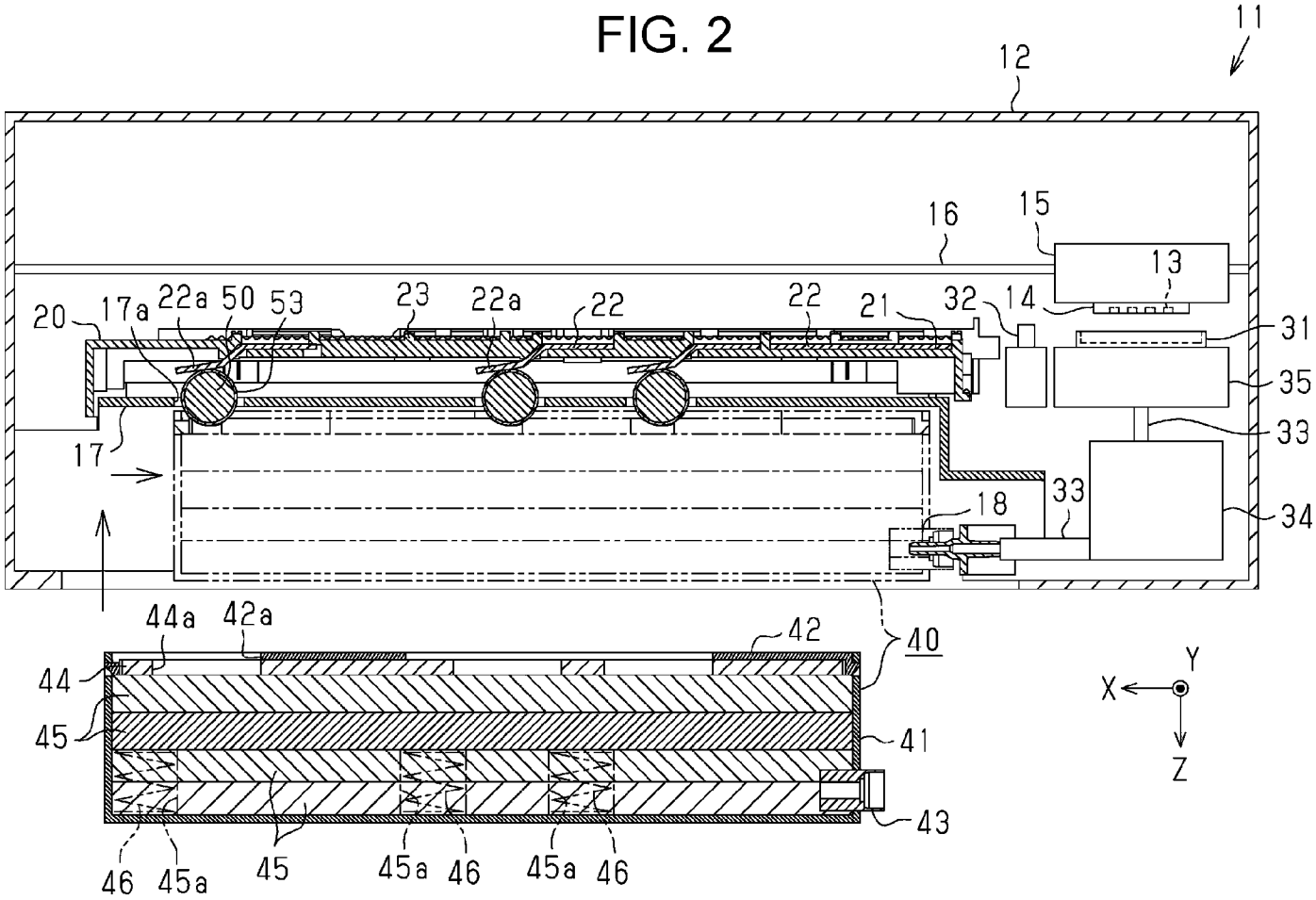
FIG. 2 is a cross-sectional view taken along a line II-II in FIG. 1.

As shown in FIG. 2, the liquid ejecting apparatus 11 includes a box-shaped mounting portion 17 in which a liquid collection container 40 for storing waste liquid is removably mounted, the mounting portion 17 being located under the medium support unit 20, an introduction needle 18 located at a downstream end of the suction tube 33, to introduce the waste liquid into the liquid collection container 40, and a relay portion 50 located in a region communicating with both of the liquid receiving portion 21 and the mounting portion 17.

When the liquid collection container 40 is inserted in the mounting portion 17 from a lower position of the casing 12, and then horizontally moved in a mounting direction (to the right in FIG. 2) toward the introduction needle 18, as indicated by arrows in FIG. 2, a joint portion 43 is connected to the introduction needle 18. At this point, the liquid collection container 40 is set in the liquid ejecting apparatus 11. The position reached by the liquid collection container 40 by the horizontal movement in the mounting direction, where the introduction needle 18 is properly inserted in the joint portion 43, will be referred to as mounting position of the liquid collection container 40 in the liquid ejecting apparatus 11.

The maintenance mechanism 30 performs maintenance operations including discharging the liquid from the liquid ejecting head 14 as waste liquid, in order to keep the ejection characteristics of the liquid ejecting head 14 in a good condition. For example, the maintenance mechanism 30 performs suction cleaning, by driving the suction pump 34 with the cap 31 set at the capping position, thereby forcibly causing the liquid in the liquid ejecting head 14 to flow out through the nozzles 13.

The liquid ejecting apparatus 11 is also configured to perform pressure cleaning, by pressurizing the liquid in the liquid ejecting head 14 so as to cause the liquid to flow out through the nozzles 13. The cleaning operations, such as the suction cleaning and the pressure cleaning may be performed during initial loading of filling the flow path as far as the nozzles 13 with the liquid, or performed in a form of manual cleaning by the user, for example for the purpose of resolving defective ejection originating from the clogging of the nozzles 13. In addition, the cleaning may be periodically performed at predetermined intervals in time.

After the cleaning, open suction is performed by driving the suction pump 34 again with the space inside the cap 31 opened to the atmosphere, for example with the cap 31 set at the retracted position, so as to suck the waste liquid remaining in the cap 31. The liquid which has flowed out of the liquid ejecting head 14 as result of the cleaning and the open suction is stored in the liquid collection container 40 through the suction tube 33, as waste liquid containing bubbles and components dissolved in the thickened liquid.

The liquid collection container 40 includes a storage case 41 having an opening on one side (upper side in the mounted state), a lid member 42 attached to the opening of the storage case 41, the joint portion 43 into which the introduction needle 18 is inserted when the liquid collection container 40 is mounted, and absorbers 44 and 45 capable of absorbing liquid and vertically superposed on each other in the storage case 41. The number, the size, and the shape of the absorbers 44 and 45 may be modified as desired.

The lid member 42 includes one or a plurality of insertion holes 42*a*. The absorber 44 located right under the lid member 42 includes insertion holes 44*a* formed so as to correspond to the respective insertion holes 42*a*. It is preferable that the joint portion 43 is located in the vicinity of the bottom portion of the storage case 41 and in contact with the absorber 45 located under the absorber 44. Here, cutaway portions 45*a* may be formed in a part of the absorber 45 in the liquid collection container 40, and biasing members 46 (e.g., coil spring) that bias the absorbers 44 and 45 toward the relay portion 50 may be provided in the respective cutaway portions 45*a*.

The medium support unit 20 includes slots 21*a* formed in the inner bottom portion of the liquid receiving portion 21 which is recessed, at positions respectively corresponding to the insertion holes 42*a* and 44*a*. The liquid absorber 22 includes a main body located in the liquid receiving portion 21 and a plurality of liquid guide portions 22*a* each extending from the main body through the slot 21*a* and hanging downward in the medium support unit 20. It is preferable to locate the liquid guide portion 22*a* in the vicinity of a region in the moving direction X where the liquid protruding from the medium S is received when the borderless printing is performed.

The mounting portion 17 includes through holes 17*a* formed at positions respectively corresponding to the liquid guide portions 22*a*. The relay portion 50 is located in the through hole 17*a*, in contact with the liquid guide portion 22*a* extending from the liquid absorber 22. Thus, the region where the relay portion 50 is located communicates with the liquid receiving portion 21 via the slot 21*a*, and with the inner space of the mounting portion 17 via the through hole 17*a*.

Figure 3:
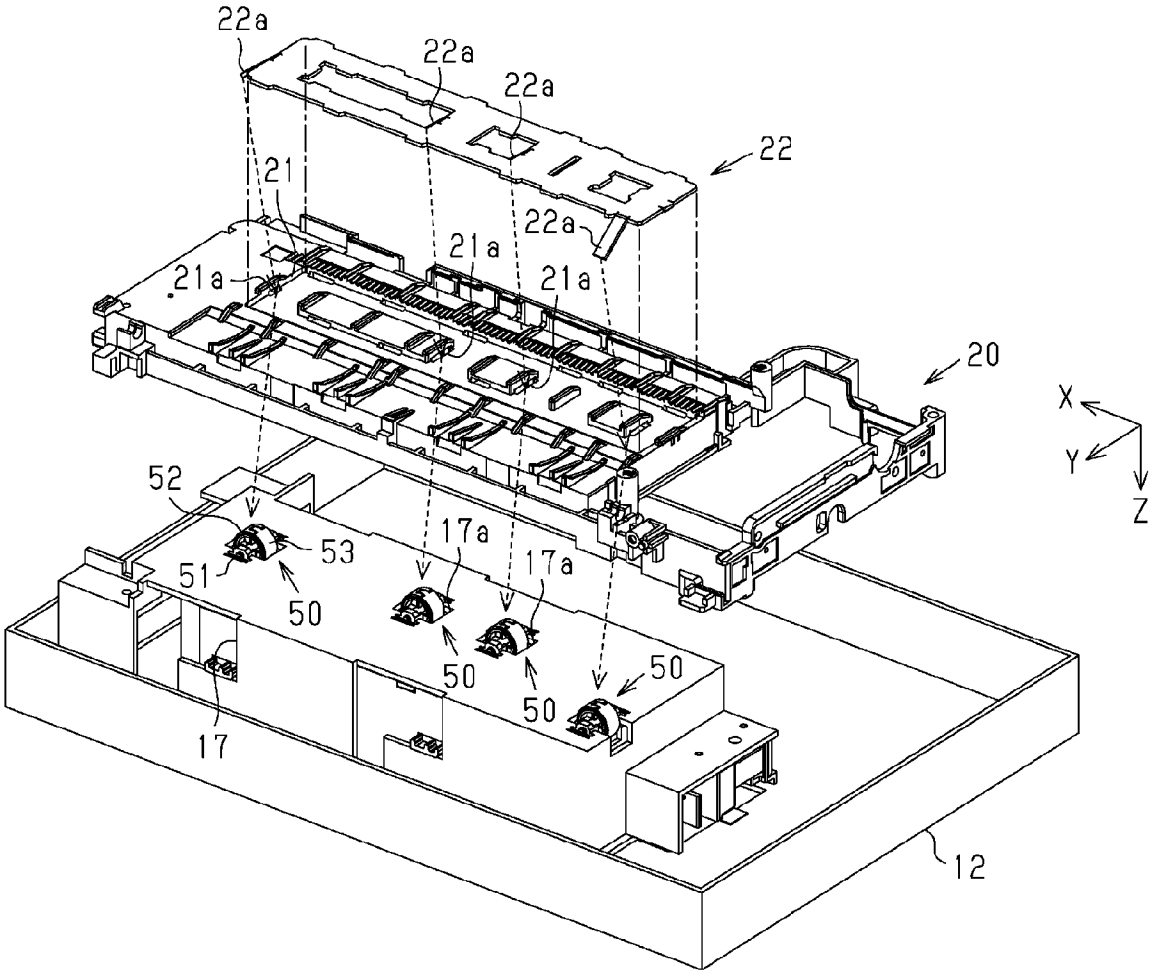
FIG. 3 is an exploded perspective view showing a liquid absorber, a medium support unit, and a mounting portion.

As show in FIG. 3, the relay portion 50 includes a roller 52 having a rotation shaft 51, and a sheet 53 covering the outer circumferential surface of the roller 52, and the rotation shaft 51 of the roller 52 is rotatably supported by the mounting portion 17, with the outer circumferential surface of the roller 52 covered with the sheet 53 protruding into the mounting portion 17. It is preferable that the sheet 53 is formed by an osmotic transfer material capable of absorbing liquid utilizing capillary force.

In this case, it is preferable to set the capillary force of the sheet 53 to be greater than that of the liquid guide portion 22*a* and smaller than that of the absorber 44 (see FIG. 2), to thereby cause the liquid to flow, owing to the capillary force, from the liquid guide portion 22*a* to the relay portion 50, and then to the absorber 44. In addition, it is preferable that the axial direction of the rotation shaft 51 of the roller 52 is oriented so as to intersect the mounting direction of the liquid collection container 40 with respect to the mounting portion 17 (e.g., orthogonal to the mounting direction).

Figure 4:
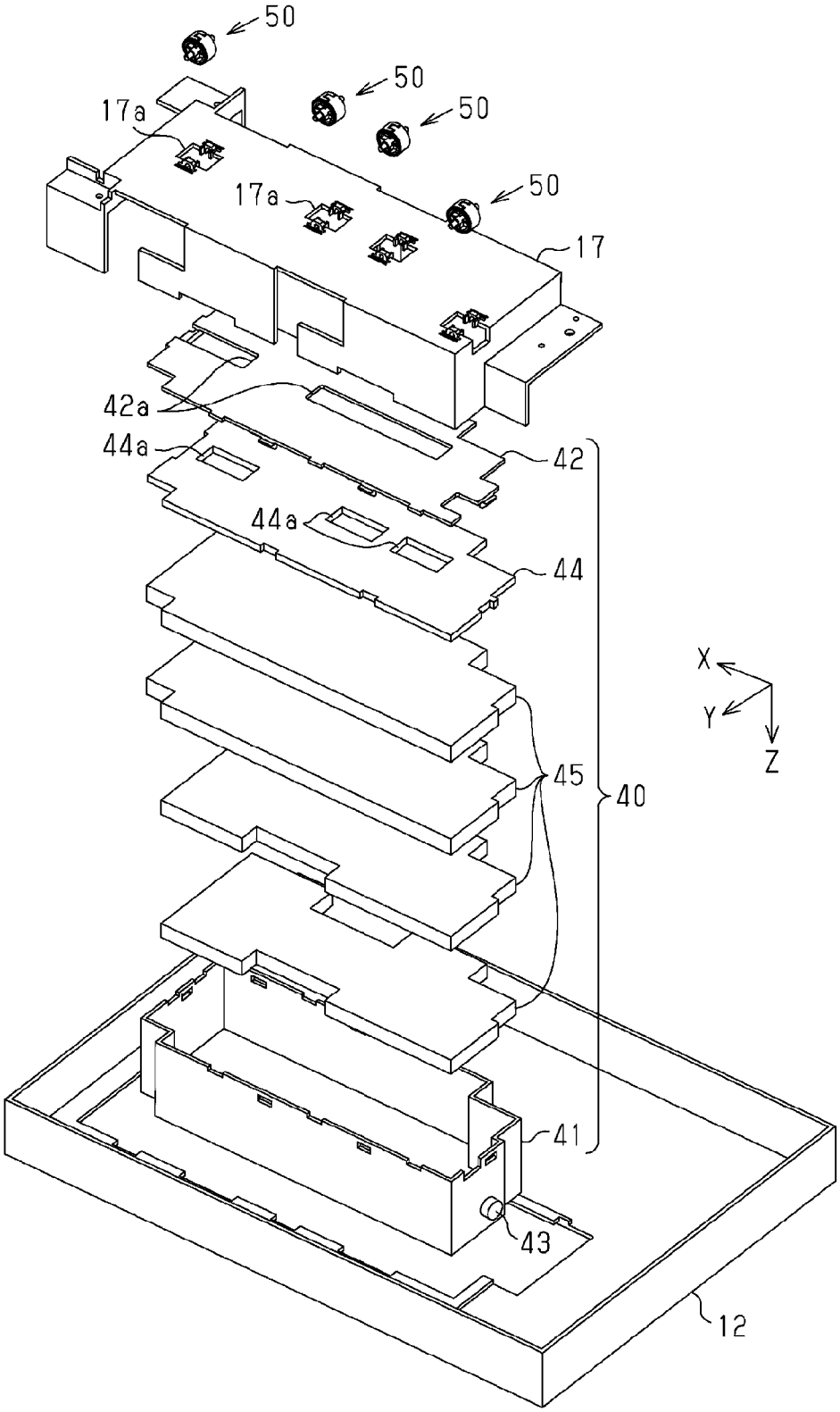
FIG. 4 is an exploded perspective view showing the mounting portion and a liquid collection container.

As shown in FIG. 4, the insertion holes 42*a* and 44*a* of the liquid collection container 40 are located so as to respectively correspond to the through holes 17*a* of the mounting portion 17 (such that the openings of the insertion holes 42*a* and 44*a* and the through hole 17*a* are vertically aligned), when the liquid collection container 40 is mounted therein. Here, it is preferable that the insertion hole 42*a* of the lid member 42 is longer in the mounting direction than the insertion hole 44*a* of the absorber 44.

When the liquid collection container 40 is inserted in the mounting portion 17 through the lower portion of the casing 12, the portion of the relay portion 50 protruding into the mounting portion 17 enters the insertion holes 42*a* and 44*a*. Then when the liquid collection container 40 is moved horizontally in the mounting direction, the relay portion 50 climbs upon the absorber 44, so as to move out from the insertion hole 44*a*. When the relay portion 50 climbs upon the absorber 44, the roller 52 rotates about the rotation shaft 51 to thereby reduce sliding resistance with respect to the absorber 44.

When the relay portion 50 climbs upon the absorber 44, the roller 52 compressively deforms the absorber 44 via the sheet 53, and therefore the relay portion 50 is subjected to pressing force of the absorber 44 attempting to restore the shape.

By mounting the liquid collection container 40 in the mounting portion 17 through the mentioned process, the relay portion 50 is located such that the sheet 53 is in contact with the absorber 44 of the liquid collection container 40 mounted in the mounting portion 17. In addition, the relay portion 50 is subjected to the pressing force of the absorber 44, compressively deformed and attempting to restore the shape, since the sheet 53 is in contact with the absorber 44 of the liquid collection container 40 mounted in the mounting portion 17. Accordingly, it is preferable that at least the portion of the relay portion 50 in contact with the absorber 44 and in contact with the liquid absorber 22 (liquid guide portion 22*a*) are formed by an osmotic transfer material (sheet 53) capable of absorbing liquid utilizing capillary force.

Examples of the osmotic transfer material suitable to form the sheet 53 include a nonwoven fabric formed by a synthetic fiber or cotton, and a paper formed by pulp or a porous metal, a mesh sheet (filter) formed by weaving a synthetic fiber or stainless steel. The roller 52 may be formed by a resin or a metal, or a porous material formed by a foamed plastic (foamed material), a nonwoven fabric, a metal, or a ceramic. In the case where the roller 52 is capable of exhibiting sufficient capillary force, the sheet 53 may be excluded from the relay portion 50.

Figure 5:
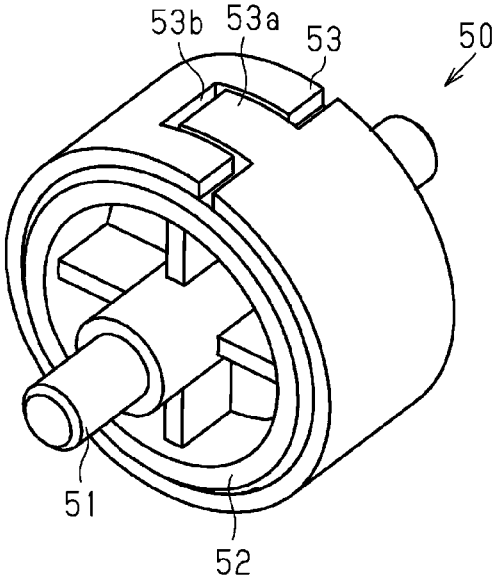
FIG. 5 is a perspective view showing a relay portion.

As shown in FIG. 5, the sheet 53 wound around the outer circumferential surface of the roller 52 of the relay portion 50 may preferably include a protruding portion 53*a*, protruding from one of the end portions opposing each other, in the central portion in the axial direction of the rotation shaft 51, and a recessed portion 53*b* formed on the other end portion of the sheet 53 so as to accommodate the protruding portion 53*a*. Such a configuration prevents the sheet 53 from being caught by the absorber 44, when the roller 52 rotates under the pressure from the absorber 44.

The liquid ejecting apparatus 11 configured as above provides the following advantageous effects.

In the liquid ejecting apparatus 11, the liquid droplets that have protruded from the edge of the medium S in the borderless printing, and the liquid dispensed away in the flushing operation are received by the liquid receiving portion 21 and absorbed by the liquid absorber 22, and then absorbed by the sheet 53 of the relay portion 50 after being transferred along the liquid guide portion 22*a*. The liquid thus absorbed by the sheet 53 migrates to the absorber 44 disposed in contact with the sheet 53.

In addition, the waste liquid discharged to the cap 31 from the liquid ejecting head 14, for example in the event of the maintenance work therefor such as cleaning, is driven by the suction pump 34 so as to be stored in the liquid collection container 40 through the suction tube 33, the introduction needle 18, and the joint portion 43, thus to be absorbed by the absorber 45.

As described above, while the waste liquid flowing down along the liquid guide portion 22*a* is absorbed by the absorber 44 through the relay portion 50, the waste liquid introduced through the joint portion 43 is absorbed by the absorber 45 disposed under the absorber 44. Therefore, the waste liquid produced inside the transport route and the waste liquid produced outside the transport route can both be efficiently absorbed into the absorbers 44 and 45 provided inside the liquid collection container 40.

When the liquid collection container 40 is fully loaded with the waste liquid, the liquid collection container 40 can be horizontally moved contrary to the mounting direction (to the left in FIG. 2) so as to separate the joint portion 43 from the introduction needle 18, and then moved downward and drawn out from the mounting portion 17. Here, when the liquid collection container 40 is drawn out also, the roller 52 of the relay portion 50 is made to rotate by the horizontal movement of the liquid collection container 40, and therefore the liquid collection container 40 can be smoothly moved despite the absorber 44 being pressed against the relay portion 50.

After the liquid collection container 40 that has been filled is drawn out, an unused liquid collection container 40 is mounted in the mounting portion 17. Since the relay portion 50 remains protruding into the mounting portion 17 maintaining the contact with the liquid guide portion 22*a* connected to the liquid absorber 22, even during the removal and mounting of the liquid collection container 40, the newly mounted liquid collection container 40 can also properly enter into contact with the absorber 44.

The foregoing embodiment provides the following advantageous effects.

(1) Since the relay portion 50 is located in the region communicating with the liquid receiving portion 21, the liquid received by the liquid receiving portion 21 can be transferred toward the relay portion 50. The relay portion 50 is disposed at a position in contact with the absorber 44 in the liquid collection container 40, and therefore the liquid received by the liquid receiving portion 21 can be absorbed through the relay portion 50 by the absorber 44 in the liquid collection container 40. The mentioned configuration allows the liquid to be properly introduced into the liquid collection container 40 which is removably mounted.

(2) Locating the main body of the liquid absorber 22 in the liquid receiving portion 21 prevents the liquid received by the liquid receiving portion 21 from splashing around. In addition, the liquid received by the liquid receiving portion 21 can be transferred toward the relay portion 50 along the liquid guide portion 22*a* extending from the main body of the liquid absorber 22, while suppressing the splashing of the liquid.

(3) The liquid absorbed by the liquid absorber 22 in the liquid receiving portion 21 can be transferred toward the liquid collection container 40, with the capillary force of the sheet 53 formed by the osmotic transfer material and provided around the relay portion 50. Causing thus the sheet 53 formed by the osmotic transfer material to absorb the liquid prevents the liquid from splashing around when the liquid is introduced into the liquid collection container 40.

(4) Locating the relay portion 50 so as to be subjected to the pressure of the absorber 44 assures that the relay portion 50 and the absorber 44 make contact with each other, even though the position of the relay portion 50 or the absorber 44 is shifted owing to a production error or deformation originating from the liquid absorption.

(5) Since the medium support unit 20 includes the liquid receiving portion 21 and the support projection 23, the liquid that has protruded from the medium S supported by the support projection 23 can be received by the liquid receiving portion 21.

(6) Since the outer circumferential surface of the roller 52 of the relay portion 50 protrudes into inside the mounting portion 17, bringing the roller 52 into contact with the absorber 44 in the liquid collection container 40 mounted in the mounting portion 17 allows the liquid to be introduced into the liquid collection container 40 through the relay portion 50.

(7) When the liquid collection container 40 is mounted in the mounting portion 17, the roller 52, having the rotation shaft 51 oriented so as to intersect the mounting direction of the liquid collection container 40, rotates, thereby reducing sliding resistance between the relay portion 50 and the absorber 44. Therefore, the relay portion 50 can be brought into contact with the absorber 44 without disturbing the mounting operation of the liquid collection container 40.

The foregoing embodiment may be modified as variations provided hereunder. Each of the variations and the embodiment may be combined as desired.

Figure 6:
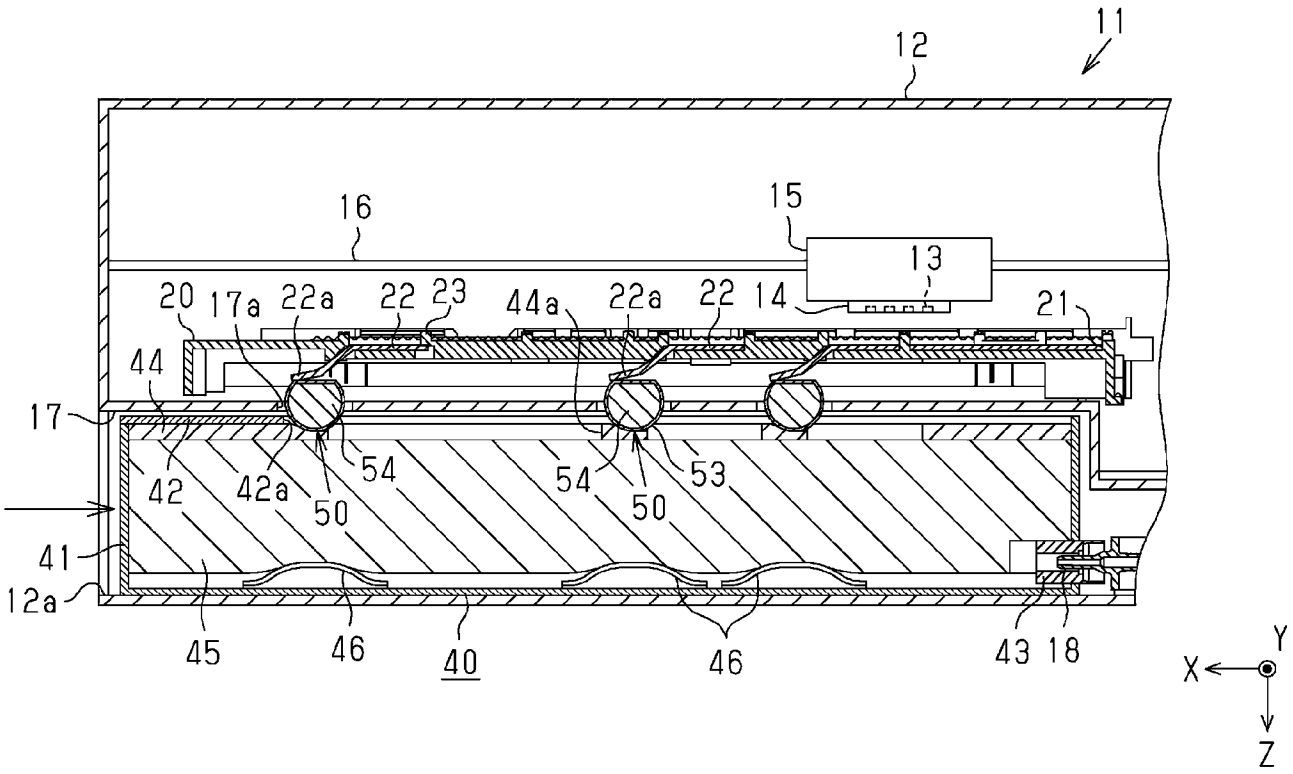
FIG. 6 is a cross-sectional view of a variation of the liquid ejecting apparatus.

Referring to the variation shown in FIG. 6, the liquid collection container 40 may be mounted in the mounting portion 17 by being moved in the mounting direction (to the right as indicated by an arrow in FIG. 6), through an insertion slot 12*a* formed in the sidewall of the casing 12 of the liquid ejecting apparatus 11.

As shown in FIG. 6, a piece of absorber 44 and a piece of absorber 45 may be accommodated in the liquid collection container 40. Alternatively, a single piece of absorber integrally formed by the absorbers 44 and 45 may be accommodated in the liquid collection container 40.

As shown in FIG. 6, the biasing member 46 provided in the liquid collection container 40 may be a leaf spring. In this case, a space for accommodating the biasing member 46 may be provided between the inner bottom portion of the storage case 41 and the absorber 45, instead of forming the cutaway portion 45*a* in the absorber 45. With such a configuration, the waste liquid introduced through the joint portion 43 along the space formed between the inner bottom portion of the storage case 41 and the absorber 45 can be spread all over the inner bottom portion of the storage case 41.

The elastic restoring force of the absorbers 44 and 45 compressively deformed by contacting the relay portion 50 may be exclusively used to apply pressure to the relay portion 50, without providing the biasing member 46 in the liquid collection container 40.

As shown in FIG. 6, the relay portion 50 may include a non-rotating core 54 and the sheet 53 wound around the core 54, instead of the roller 52. In this case, it is preferable to reduce the sliding resistance in the removal and mounting, for example by forming a portion of the core 54 to be in contact with the absorber 44 in a curved surface. It is also preferable to form a portion of the core 54 to be in contact with the liquid guide portion 22*a* in a flat surface, because the flat surface assures that the contact with the liquid guide portion 22*a* can be achieved.

The liquid guide portion 22*a* may be separately formed from the main body of the liquid absorber 22, and such liquid guide portion 22*a* may be disposed in contact with the liquid absorber 22, so as to transfer the liquid toward the relay portion 50 from the liquid absorber 22, through the liquid guide portion 22*a*.

Instead of providing the sheet 53 around the relay portion 50, grooves may be formed on the outer circumferential surface of the roller 52 by forming, sintering, or cutting, so as to transfer the liquid along the grooves.

Instead of providing the liquid guide portion 22*a* in the liquid absorber 22, and extension extending from the relay portion 50 toward the liquid absorber 22 may be formed, so as to transfer the liquid from the liquid absorber 22 to the relay portion 50 by disposing the extension in contact with the liquid absorber 22.

Instead of accommodating the liquid absorber 22 in the liquid receiving portion 21, the liquid received by the liquid receiving portion 21 may be caused to drop onto the relay portion 50 through the slot 21*a*.

While introducing the liquid collected through the liquid receiving portion 21 into the liquid collection container 40, the waste liquid collected through the cap 31 may be introduced into another container.

It is not mandatory to form the liquid receiving portion, configured to receive the liquid ejected by the liquid ejecting head 14, as a part of the medium support unit 20. For example when the liquid ejecting apparatus 11 is not used for the borderless printing, the liquid receiving portion may be provided on the end portion on the opposite side of home with respect to the medium support unit 20 in the travel range of the liquid ejecting head 14, and the flushing may be performed toward the liquid receiving portion. Locating the relay portion 50 in a region communicating with the liquid receiving portion serving as a flushing box allows the liquid to be introduced through the relay portion 50 into the liquid collection container 40 mounted in the mounting portion 17.

Second Embodiment

Figure 7:
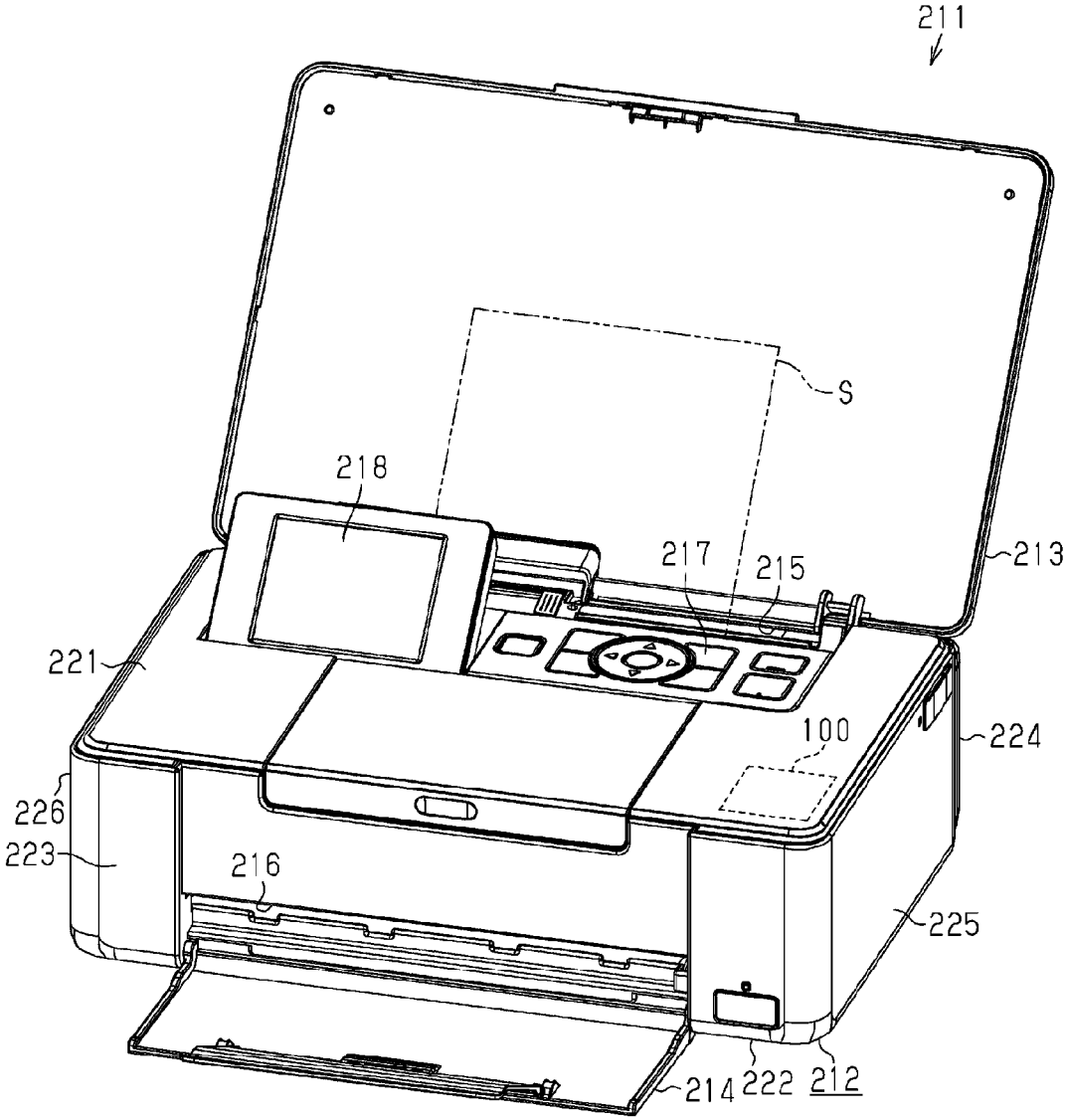
FIG. 7 is a perspective view showing a liquid ejecting apparatus according to a second embodiment.

Referring to FIG. 7, a liquid ejecting apparatus 211 includes a box-shaped casing 212, an upper lid 213 pivotably attached to the casing 212, and a front lid 214 also pivotably attached to the casing 212. The upper lid 213 and the front lid 214 can each be set in a closing position covering the casing 212 and an open position shown in FIG. 7, by being made to pivot to a predetermined angle.

When the upper lid 213 is set to the open position, an insertion slot 215 through which the medium S is inserted in the casing 212 is exposed. The upper lid 213 set to the open position serves as a support member for supporting the medium S about to be inserted through the insertion slot 215.

When the front lid 214 is set to the open position, a discharge port 216 through which the medium S is discharged from the casing 212 is exposed. The front lid 214 set to the open position serves as a support member for supporting the medium S discharged through the discharge port 216.

Regarding the casing 212, an outer wall in which the insertion slot 215 is opened will be referred to as upper wall 221, an outer wall formed substantially parallel to the upper wall 221 will be referred to as bottom plate 222, an outer wall in which the discharge port 216 is opened will be referred to as forward wall 223, and an outer wall formed substantially parallel to the forward wall 223 will be referred to as rear wall 224. In addition, regarding the casing 212, a pair of outer walls intersecting the upper wall 221, bottom plate 222, forward wall 223, and the rear wall 224 will be referred to as sidewalls 225 and 226. The face of the casing 212 on the side of the upper wall 221 may be referred to as top face side, and the face of the casing 212 on the side of the bottom plate 222 may be referred to as bottom face side.

On the surface of the upper wall 221 (top face side), an operation unit 217 for operating the liquid ejecting apparatus 211, and a display unit 218 for displaying operation results of the operation unit 217 and operation status of the liquid ejecting apparatus 211 are provided. In addition, a control unit 100 that controls the functional units of the liquid ejecting apparatus 211 is provided on the lower surface of the upper wall 221, at a position close to the forward wall 223 and the sidewall 225.

Figure 8:
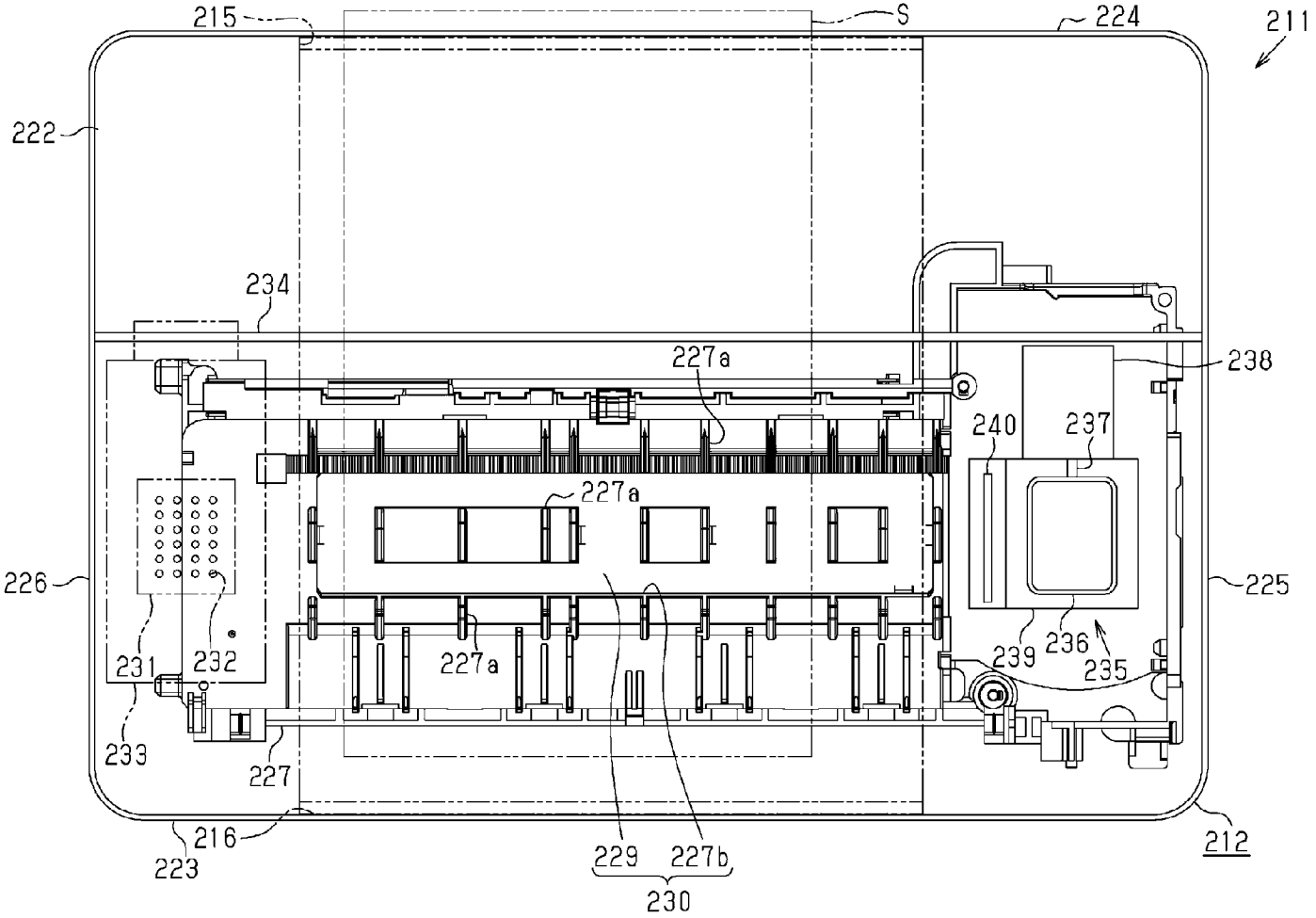
FIG. 8 is a schematic plan view showing a configuration in a casing provide in the liquid ejecting apparatus shown in FIG. 7.

As shown in FIG. 8, the casing 212 includes therein a support member 227 having a medium support unit 227*a*, a liquid ejecting head 231 that ejects the liquid onto the medium S supported by the medium support unit 227*a*, and a carriage 233 that reciprocates with the liquid ejecting head 231 mounted thereon. The medium support unit 227*a* is composed of a plurality of projections that support the medium S transported along a transport route extending from the insertion slot 215 to the discharge port 216 (indicated by dash-dot-dot lines in FIG. 8). In addition, a guide shaft 234 that guides the movement of the carriage 233 is spanned inside the casing 212.

The liquid ejecting head 231 includes a plurality of nozzles 232 that each eject the liquid in the form of liquid droplets. The liquid ejecting head 231 alternately makes a forward stroke and a backward stroke, the former being made from a home position, set at a first end portion (right end in FIG. 8) of the casing 212 in the longitudinal direction of the casing 212 (left-right direction in FIG. 8), to a second end portion (left end in FIG. 8) in the longitudinal direction, and the latter being made from the second end portion to the home position.

In this embodiment, a direction in which the liquid ejecting head 231 ejects the liquid will be defined as ejection direction, a direction in which the medium S is transported on the medium support unit 227*a* from the insertion slot 215 to the discharge port 216 will be defined as transport direction, and a forward moving direction of the liquid ejecting head 231 will be defined as scanning direction. In this embodiment, the ejection direction corresponds to a vertical downward direction (gravity direction).

The support member 227 includes a receiving recess 227*b* formed so as to recede around the medium support unit 227*a*. It is preferable that a sheet 229 capable of absorbing liquid is accommodated in the receiving recess 227*b*. The sheet 229 is formed by a nonwoven fabric or a porous material, and serves to receive the liquid droplets that have protruded from the medium S instead of landing thereon, after being ejected from the liquid ejecting head 231 to the edge portion of the medium S, in the case of performing the borderless printing without leaving a margin along the edge of the medium S. In other words, the receiving recess 227*b* and the sheet 229 serve as a waste liquid receiving portion 230 that receives the liquid ejected by the liquid ejecting head 231 as waste liquid. Here, the waste liquid received by the waste liquid receiving portion 230 will be referred to as "ejected waste liquid"

In the casing 212, a maintenance mechanism 235 that performs maintenance work for the liquid ejecting head 231 is provided close to the home position. The maintenance mechanism 235 includes a cap 236 located at a position corresponding to the home position, a suction mechanism 238 connected to the cap 236 via the suction tube 237, a lifting mechanism 239 that moves the cap 236 up and downward, and a wiper 240 that wipes the liquid ejecting head 231.

The lifting mechanism 239 moves the cap 236 between the capping position and the retracted position closer to the bottom plate 222 than is the capping position. When the cap 236 is set to the capping position when the liquid ejecting head 231 is at the home position, the cap 236 defines a closed space in which the nozzles 232 are open (see FIG. 18), thereby preventing the nozzles 232 from drying. Forming thus the closed space having the openings provided by the nozzles 232 with the cap 236 will be referred to as "capping". When the liquid is not ejected, for example while the power is off, the liquid ejecting head 231 is set at the home position and the cap 236 is set at the capping position to perform the capping. When the cap 236 moves from the capping position to the retracted position, the capping is cancelled.

The suction mechanism 238 is constituted of a suction pump including a tube pump, for example formed by an elastically deformable tube, configured to generate suction force by being pressed by a moving pressing member such as a roller. When the suction mechanism 238 is activated in the capping state, the closed space is depressurized and negative pressure is generated. Accordingly, suction cleaning, including discharging the liquid from the liquid ejecting head 231 through the nozzle 232, is performed. The suction cleaning is performed, for example when the liquid ejection becomes defective owing to intrusion of a bubble, to correct the defective ejection, as a part of the maintenance work.

The wiper 240 serves to wipe off foreign matters such as liquid stuck to the liquid ejecting head 231, after the liquid ejecting head 231 ejects the liquid or after the suction cleaning. The maintenance performed by the wiper 240 to wipe the liquid ejecting head 231 will be referred to as wiping.

The maintenance work for correcting the defective ejection further includes flushing, in which the liquid ejecting head 231 dispenses away the liquid droplets toward the cap 236 set at the retracted position or the waste liquid receiving portion 230. Here, the waste liquid dispensed from the liquid ejecting head 231 as waste liquid in the event of the suction cleaning or the flushing, and discharged by the mechanism 238 after being received by the cap 236, will be referred to as "sucked waste liquid".

Figure 9:
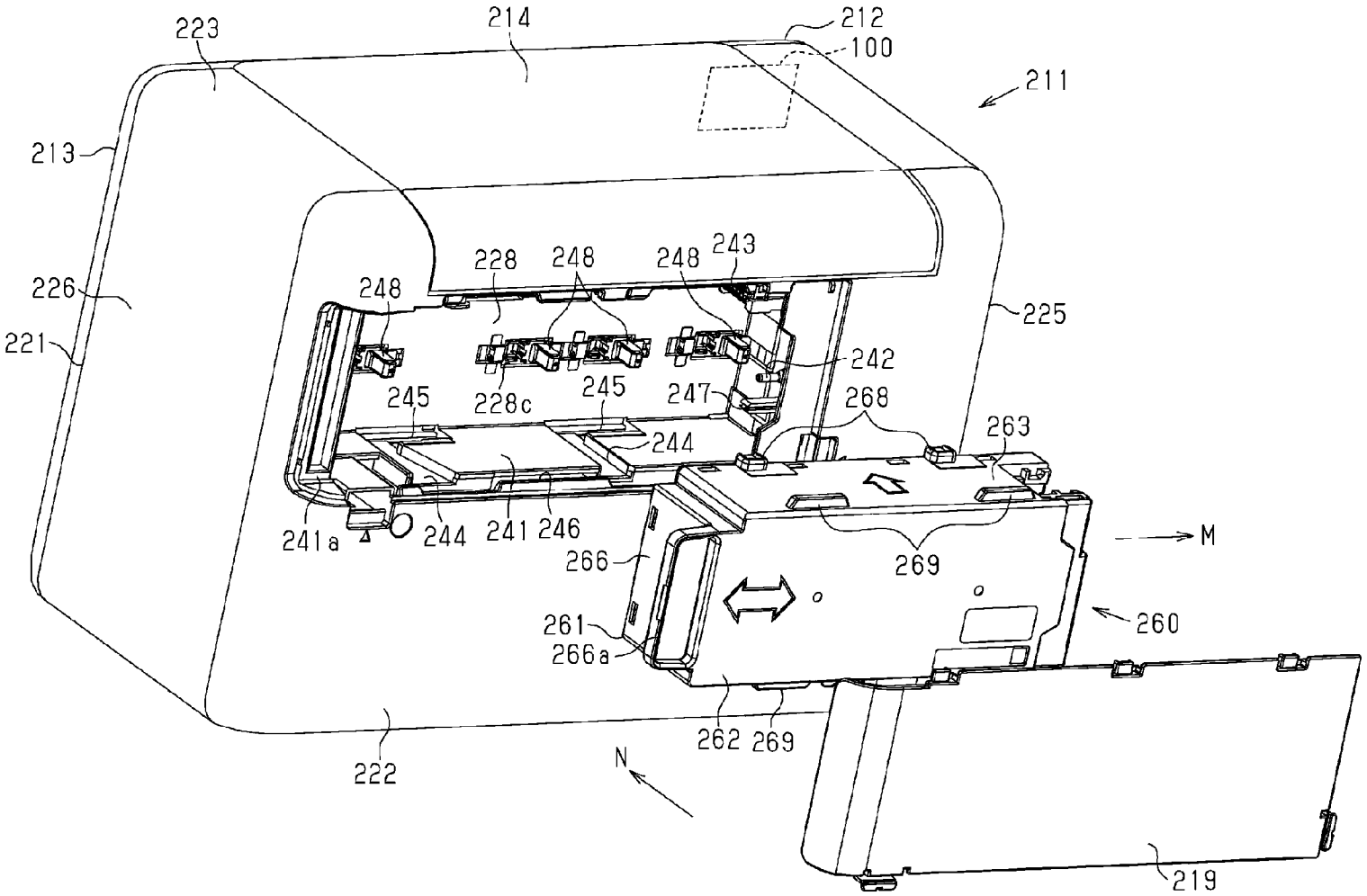
FIG. 9 is a perspective view showing how the waste liquid reservoir is mounted in the liquid ejecting apparatus shown in FIG. 7.

As shown in FIG. 9, the liquid ejecting apparatus 211 includes, in the bottom portion of the casing 212, a mounting chamber 241 in which a waste liquid reservoir 260 is to be removably mounted, and a lid 219 that covers the mounting chamber 241. The waste liquid reservoir 260 includes a waste liquid storage container 261 for storing both of the ejected waste liquid and the sucked waste liquid. Inside the mounting chamber 241, a discharge unit 242 that discharges the sucked waste liquid, and a substrate connection unit 243 connected to the control unit 100 via a non-illustrated signal line are provided.

The waste liquid reservoir 260 is introduced in the mounting chamber 241 by being moved in an insertion direction N, and mounted in the liquid ejecting apparatus 211 by being moved in a connection direction M in the mounting chamber 241, different from the insertion direction N. In this embodiment, the insertion direction N represents a direction from the bottom plate 222 toward the upper wall 221, and the connection direction M represents a direction from the sidewall 226 toward the sidewall 225. The waste liquid reservoir 260 mounted in the liquid ejecting apparatus 211 is released from the connection by being moved inside the mounting chamber 241 in a direction opposite to the connection direction M (release direction), and taken out of the mounting chamber 241 by being moved in a direction opposite to the insertion direction N (removal direction). Preferably, the waste liquid reservoir 260 may include a handle 266*a* that can be held by the user when moving the waste liquid reservoir 260 inside the mounting chamber 241.

The mounting chamber 241 may include an insertion guide portion 244 for guiding the waste liquid reservoir 260 moving in the insertion direction N, and mounting guide portions 245 and 246 each extending in the connection direction M from the end portion of the insertion guide portion 244 so as to guide the waste liquid reservoir 260 in the connection direction M. In this case, it is preferable to form, in the waste liquid reservoir 260, a first engaging projection 268 to be engaged with the insertion guide portion 244 and the mounting guide portion 245, and a second engaging projection 269 to be engaged with the mounting guide portion 246.

It is preferable to form the discharge unit 242 and the substrate connection unit 243 so as to project into the mounting chamber 241 along the connection direction M. In addition, it is preferable to form, in the mounting chamber 241, a guide projection 247 so as to project in the connection direction M, to position the waste liquid reservoir 260 mounted in the mounting chamber 241.

It is preferable to form one or a plurality of waste liquid transfer portions 248 so as to project into the mounting chamber 241 from the waste liquid receiving portion 230 (see FIG. 8). In the case of providing a plurality of waste liquid transfer portions 248 (four in this embodiment), it is preferable to align the waste liquid transfer portions 248 in the longitudinal direction of the mounting chamber 241 (connection direction M in this embodiment).

Figure 10:
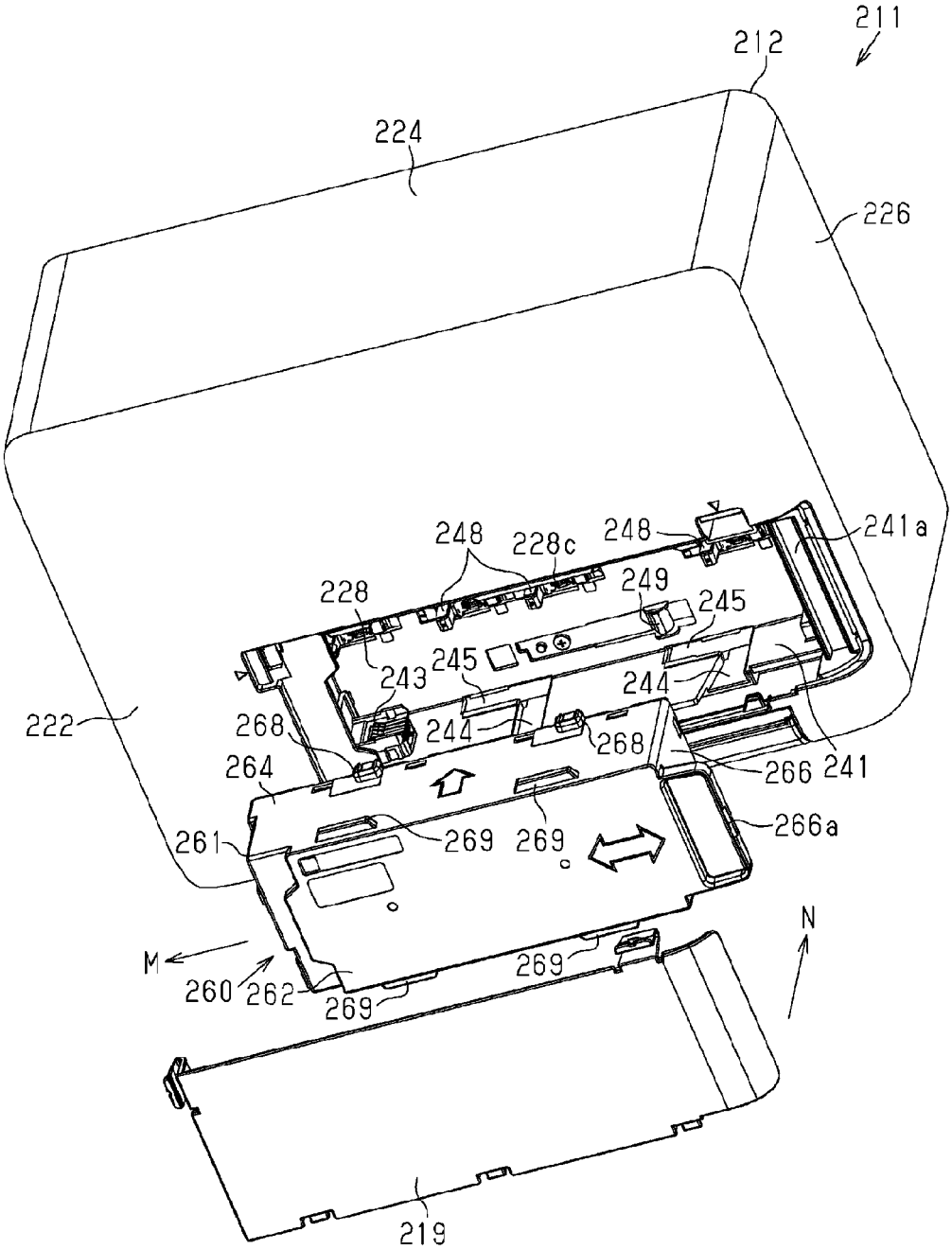
FIG. 10 is a perspective view corresponding to FIG. 9, seen from a different position.

Referring to FIG. 10, it is preferable to form, in the mounting chamber 241, a detent portion 249 that detains the waste liquid storage container 261. The detent portion 249 may be constituted, for example, of a leaf spring projecting into the mounting chamber 241. In this case, the detent portion 249 may be configured so as to be engaged with the waste liquid storage container 261 when the waste liquid reservoir 260 which has entered the mounting chamber 241 moves in the connection direction M.

Figure 11:
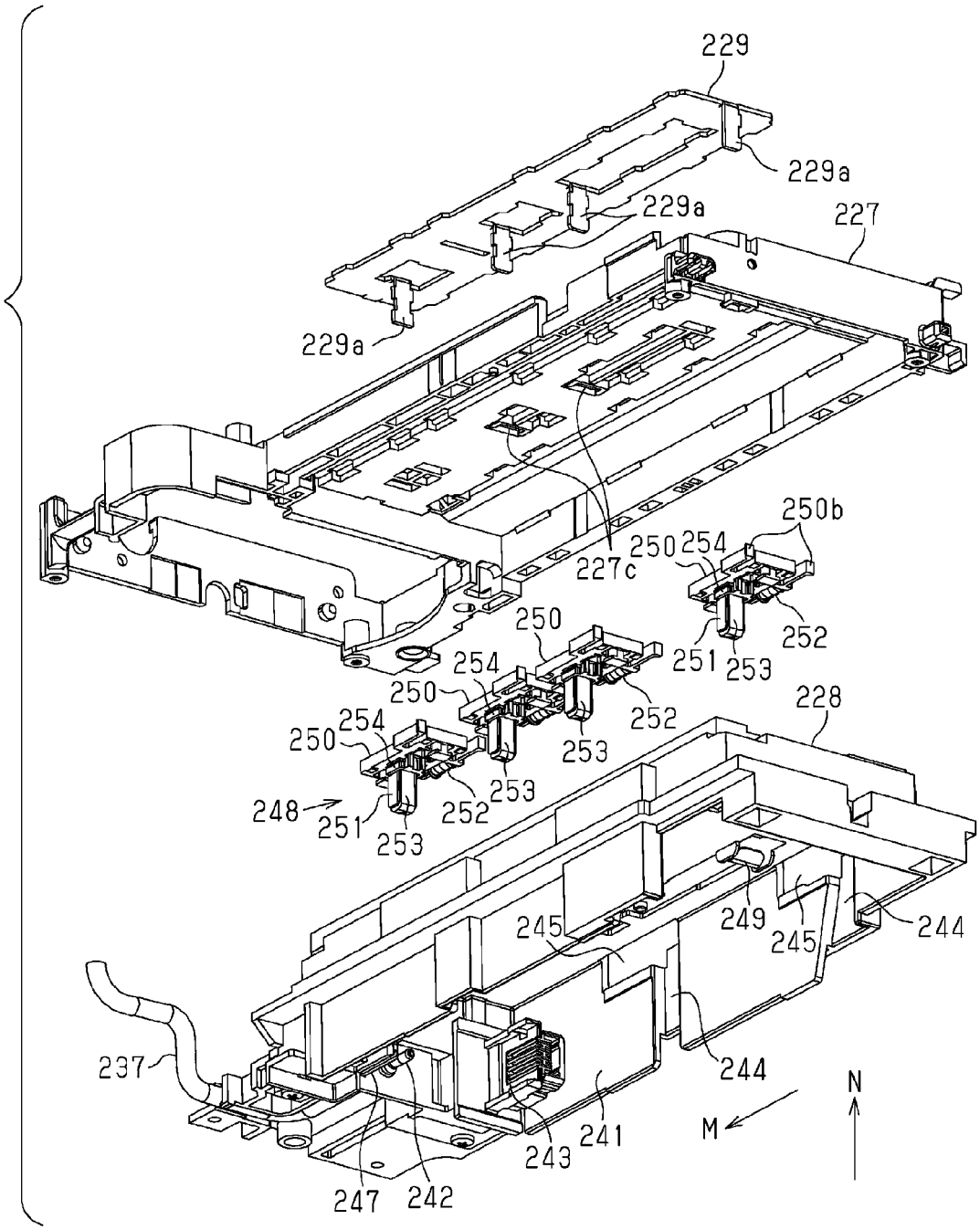
FIG. 11 is an exploded perspective view showing an internal configuration of the liquid ejecting apparatus shown in FIG. 7.

As shown in FIG. 11, the mounting chamber 241 includes a box-shaped storage frame 228 open toward the bottom face side and located on the bottom face side with respect to the support member 227. In addition, a slider 250 set to slide along the connection direction M is provided between the support member 227 and the storage frame 228. The slider 250 includes a transfer projection 251 projecting toward the bottom face side. The transfer projection 251 may be covered with an absorption sheet 253 capable of absorbing liquid.

The sheet 229 includes one or a plurality of extensions 229*a* (four in this embodiment) extending toward the bottom face side. A plurality of the sliders 250 may be provided at positions respectively corresponding to the extensions 229*a*. The support member 227 includes through holes 227*c* through which the respective extensions 229*a* are passed, and the extensions 229*a* are each formed so as to reach, through the through hole 227*c*, the transfer projection 251 of the slider 250 (or the absorption sheet 253 when the absorption sheet 253 is provided).

The ejected waste liquid received by the sheet 229 flows downward along the extension 229*a* and the absorption sheet 253 (or the transfer projection 251 when the absorption sheet 253 is not provided). Accordingly, the extension 229*a* of the sheet 229, the absorption sheet 253 and the transfer projection 251 constitute the waste liquid transfer portion 248. Here, it is preferable to provide an auxiliary member 254 that presses the extension 229*a* against the transfer projection 251, to prevent the extension 229*a* from being separated from the absorption sheet 253 when the slider 250 moves (see also FIG. 17).

Figure 12:
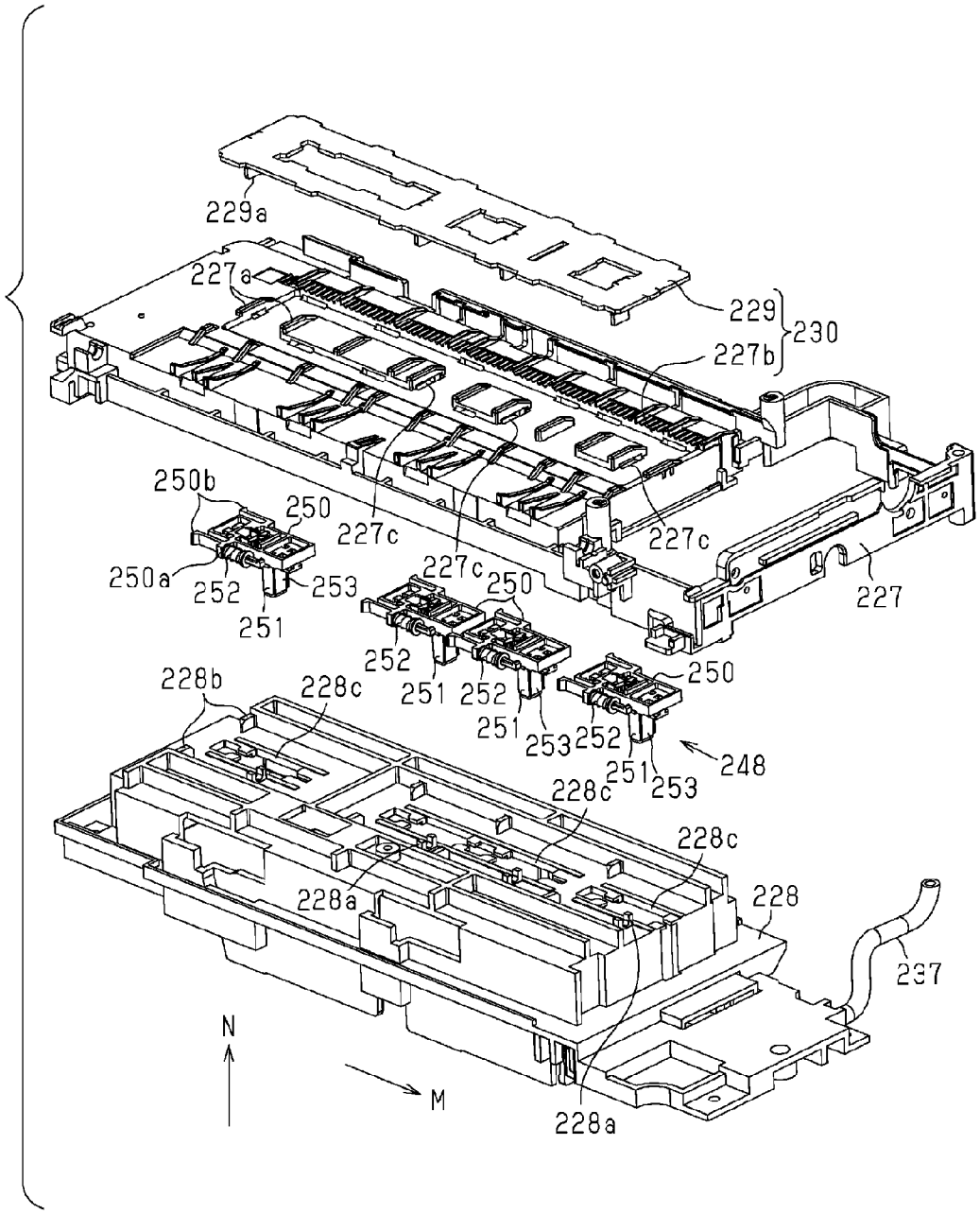
FIG. 12 is a perspective view corresponding to FIG. 11, seen from a different position.

Referring to FIG. 12, it is preferable to bias the slider 250 in the release direction with a biasing member 252, for example formed by a spring. In this case, the slider 250 may include a first detent portion 250*a* to be engaged with an end portion of the biasing member 252, and the storage frame 228 may include a second detent portion 228*a* to be engaged with the other end portion of the biasing member 252. In addition, the storage frame 228 may include stopper projections 228*b* that each delimit the movement of the slider 250 caused by the biasing member 252, and the slider 250 may include lugs 250*b* to be abutted against the respective stopper projections 228*b*.

The storage frame 228 includes through holes 228*c* through which the waste liquid transfer portions 248 are respectively passed. It is preferable to form the through hole 228*c* so as to extend in the connection direction M, to allow the waste liquid transfer portion 248 to move together with the slider 250.

The configuration of the waste liquid reservoir 260 will now be described in detail.

Figure 13:
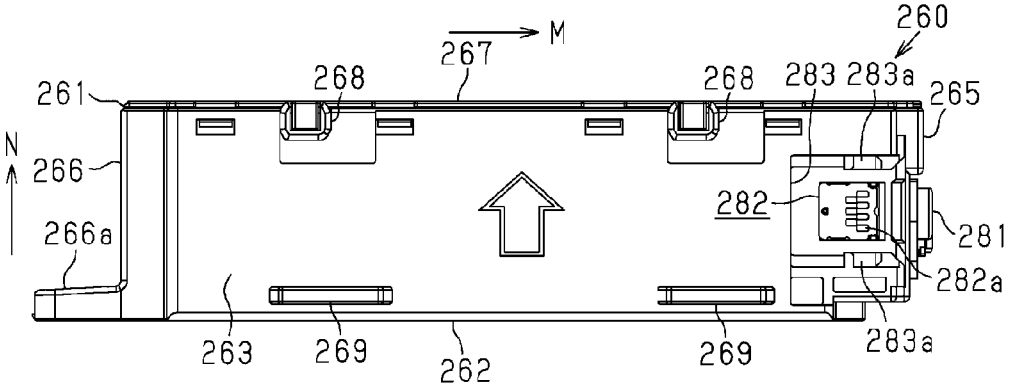
FIG. 13 is a left side view of the waste liquid reservoir according to the first embodiment.

As shown in FIG. 13, the waste liquid reservoir 260 includes a waste liquid introduction port 281 through which the sucked waste liquid is introduced, and a circuit board 282 having a connection terminal 282*a*. The circuit board 282 includes a non-illustrated storage unit for storing information such as a storage amount of the waste liquid.

Figure 14:
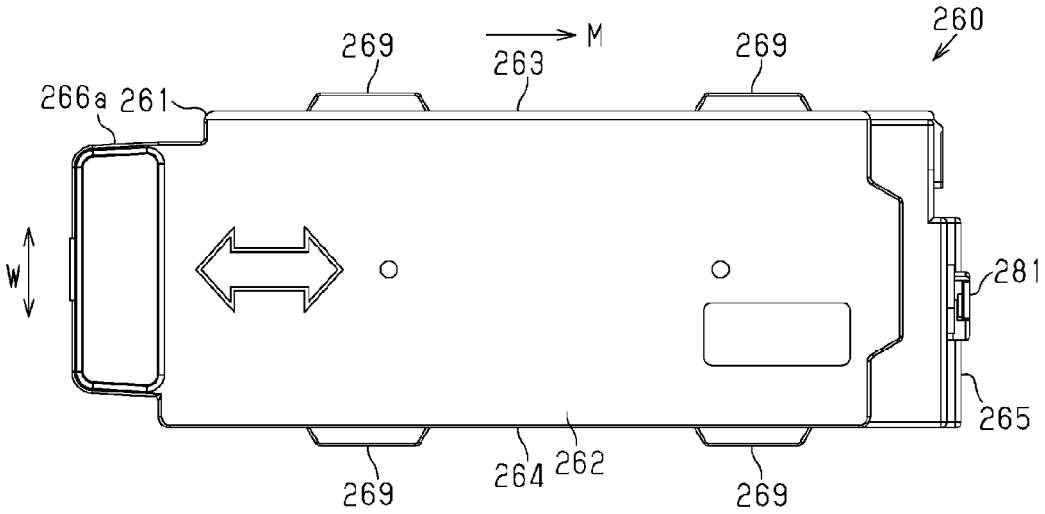
FIG. 14 is a bottom view of the waste liquid reservoir shown in FIG. 13.
Figure 15:
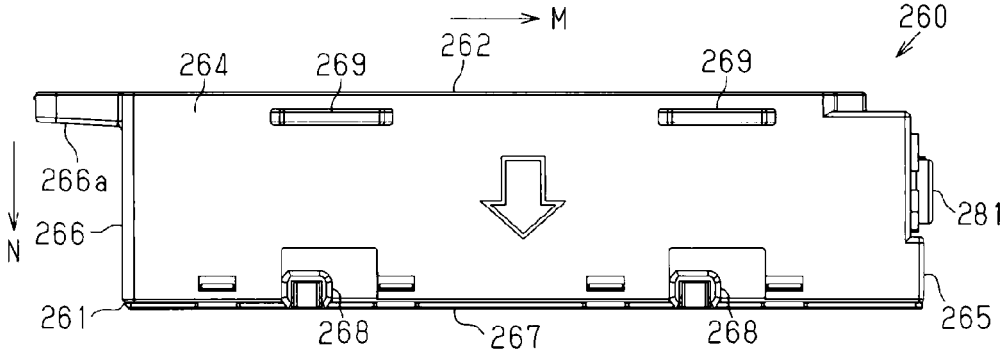
FIG. 15 is a right side view of the waste liquid reservoir shown in FIG. 13.

Marking the moving directions (insertion direction N, connection direction M, and release direction) for the removal and mounting of the waste liquid reservoir 260 by arrows as shown in FIG. 13 to FIG. 15 facilitates the handling of the waste liquid reservoir 260.

Figure 16:
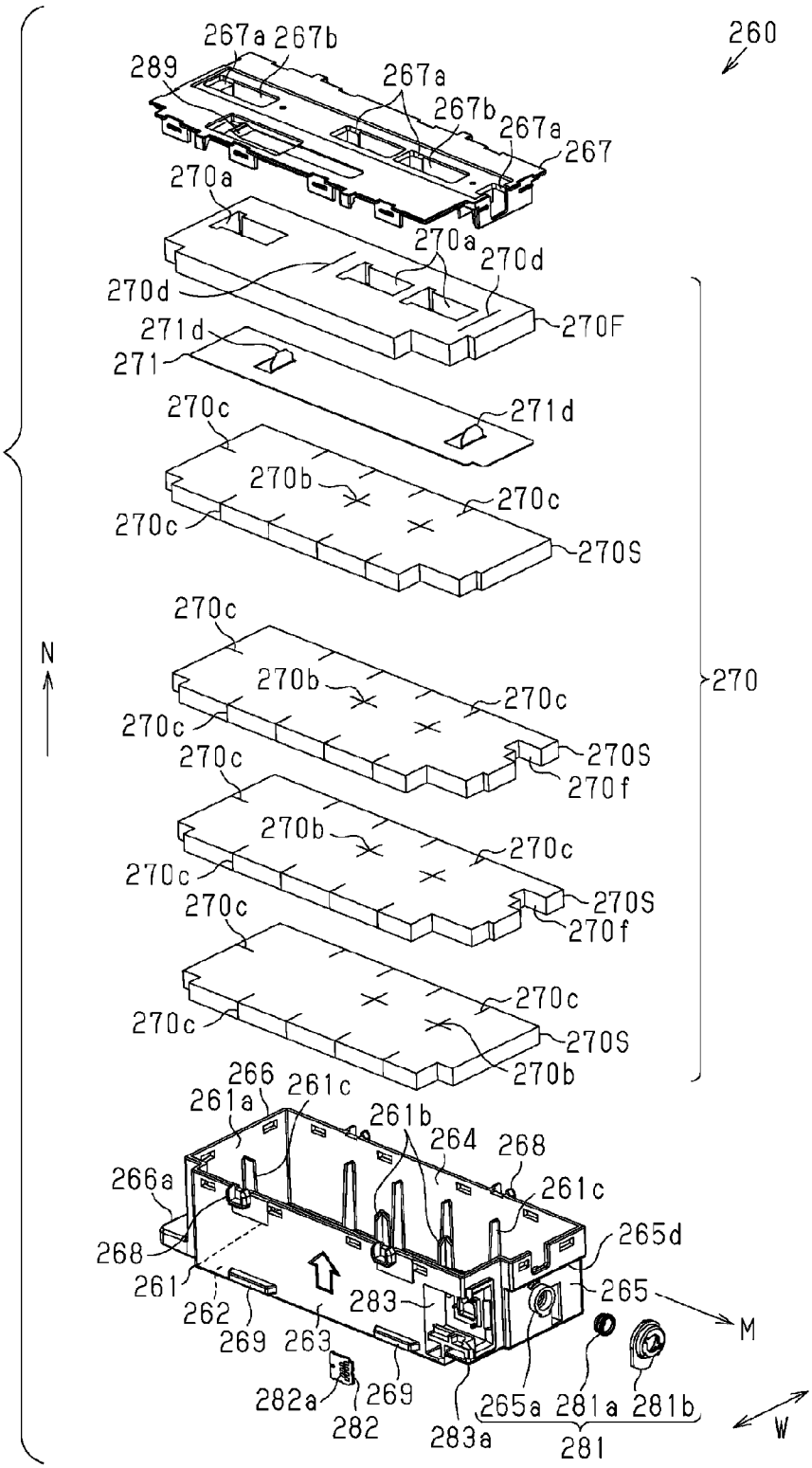
FIG. 16 is an exploded perspective view of the waste liquid reservoir shown in FIG. 13.

As shown in FIG. 16, the waste liquid storage container 261 of the waste liquid reservoir 260 includes a bottom plate 262, sidewalls 263 and 264, and a front and a rear wall 265 and 266 defining a waste liquid storage chamber 261*a* for storing the waste liquid, and a lid 267 constituting the ceiling of the waste liquid storage chamber 261*a*. The sidewalls 263 and 264 are substantially parallel to each other, and extend in the insertion direction N and the connection direction M.

It is preferable to store the circuit board 282 in a recess 283 formed in the sidewall 263 of the waste liquid storage container 261 extending in the connection direction M with an opening oriented in the connection direction M. In addition, a guide projection 283*a* may be formed in the recess 283 so as to extend in the connection direction M. Here, the inner wall of the recess 283 extending in the connection direction M, on which the circuit board 282 is attached, constitutes a part of the sidewall 263.

The waste liquid introduction port 281 is formed in the front wall 265 of the waste liquid storage container 261, intersecting the sidewalls 263 and 264 and the bottom plate 262. The waste liquid introduction port 281 is composed of, for example, a through hole 265*a* formed in the front wall 265, an annular seal member 281*a* surrounding the through hole 265*a*, and an annular member 281*b* that fixes the seal member 281*a*.

Preferably, the waste liquid reservoir 260 may include an absorber 270 capable of absorbing the waste liquid stored in the waste liquid storage chamber 261*a*. It is preferable that the absorber 270 includes a first absorber 270F for absorbing the ejected waste liquid and a second absorber 270S for absorbing the sucked waste liquid. In addition, it is preferable to provide a shielding sheet 271 between the first absorber 270F and the second absorber 270S, to suppress the migration of the liquid. The size and the number of the absorbers 270 (270F, 270S) may vary depending on the discharge amount of the waste liquid to be absorbed. In this embodiment, for example, four plate-shaped second absorbers 270S are sequentially stacked in layers from the side of the bottom plate 262.

The waste liquid storage container 261 may include detent projections 261*b* projecting into the waste liquid storage chamber 261*a* from the bottom plate 262, and detent projection 261*c* projecting into the waste liquid storage chamber 261*a* from the sidewalls 263 and 264 and the rear wall 266. In this case, cut lines 270*b* and 270*c* may be formed in the second absorbers 270S so as to be respectively engaged with the detent projections 261*b* and 261*c*, and the second absorbers 270S may be placed in the waste liquid storage chamber 261*a* by respectively inserting the detent projections 261*b* and 261*c* in the cut lines 270*b* and 270*c*, in which case the second absorbers 270S can be prevented from being displaced in the waste liquid storage chamber 261*a*. In addition, the shielding sheet 271 may be cut so as to erect segments 271*d*, and cut lines 270*d* may be formed in the first absorber 270F at positions respectively corresponding to the segments 271*d*, so that the first absorber 270F and the shielding sheet 271 may be placed in the waste liquid storage chamber 261*a*, with the segments 271*d* inserted in the cut lines 270*d*.

Locating the shielding sheet 271 so as to be supported by the detent projections 261*b* and 261*c*, when placing the first absorber 270F and the shielding sheet 271 in the waste liquid storage chamber 261*a*, allows the first absorber 270F which has absorbed the waste liquid to be supported by the detent projections 261*b* and 261*c*, so as to be prevented from sinking downward owing to the self-weight. In this embodiment, a stepped portion 265*d* is formed on the front wall 265 of the waste liquid storage container 261, so as to support the shielding sheet 271 also with the stepped portion 265*d* (see also FIG. 18).

Figure 18:
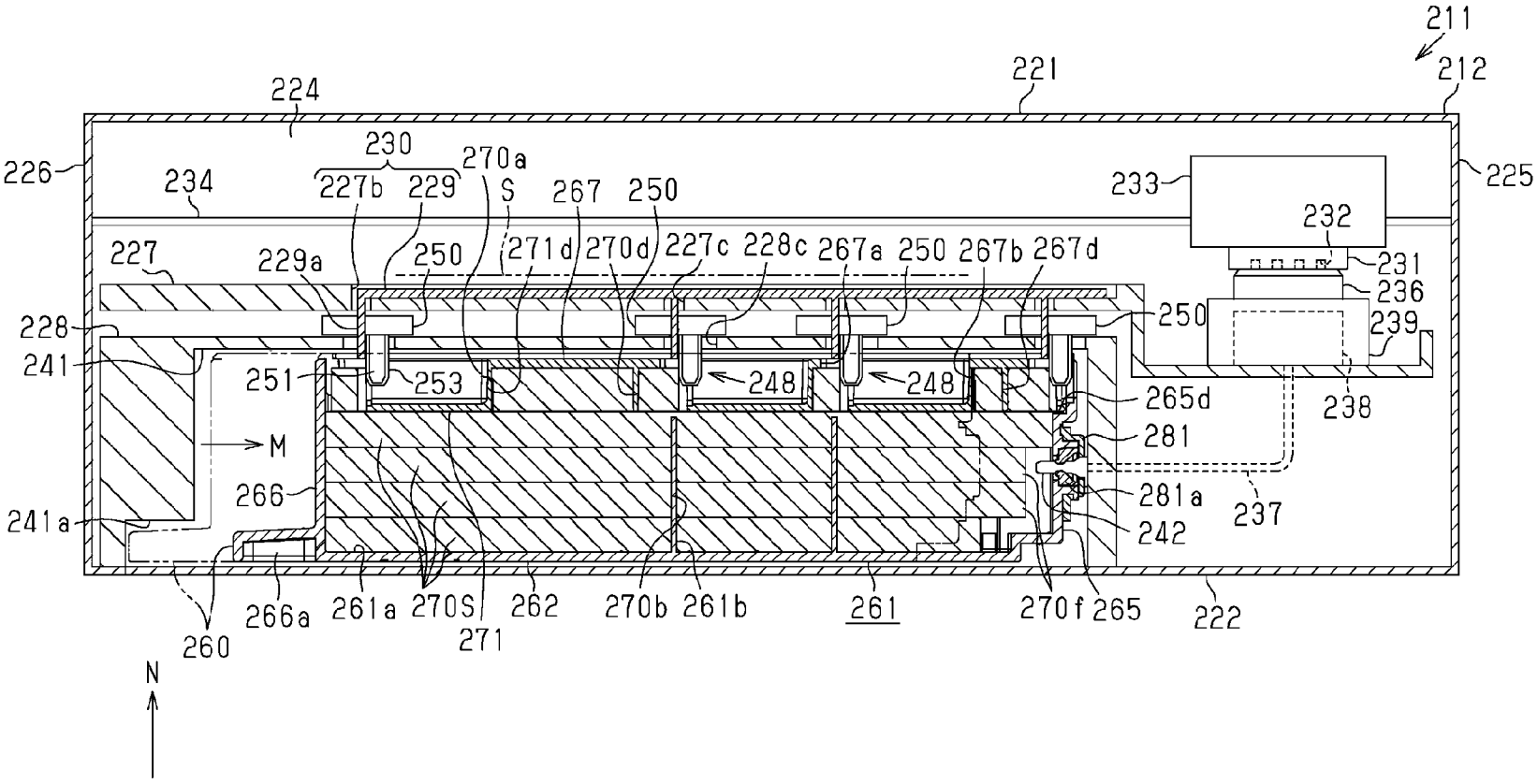
FIG. 18 is a cross-sectional view of the waste liquid reservoir mounted in the liquid ejecting apparatus shown in FIG. 7.

The lid 267 constituting the ceiling of the waste liquid storage chamber 261*a* includes waste liquid inlets 267*a*, having an opening oriented in the insertion direction N so as to allow the ejected waste liquid received by the waste liquid receiving portion 230 (see FIG. 12) to be introduced in the waste liquid storage chamber 261*a*, when the waste liquid reservoir 260 is mounted in the mounting chamber 241 (see FIG. 9) by being moved in the insertion direction N (see also FIG. 18).

In this embodiment, the waste liquid storage container 261 includes a plurality of (four) waste liquid inlets 267*a* aligned in the connection direction M. The first absorber 270F includes through holes 270*a* formed at positions respectively corresponding to three of the waste liquid inlets 267*a* out of the four. The remaining one of the four waste liquid inlets 267*a* is located at a position corresponding to an end portion of the first absorber 270F (leading end in the connection direction M).

Figure 17:
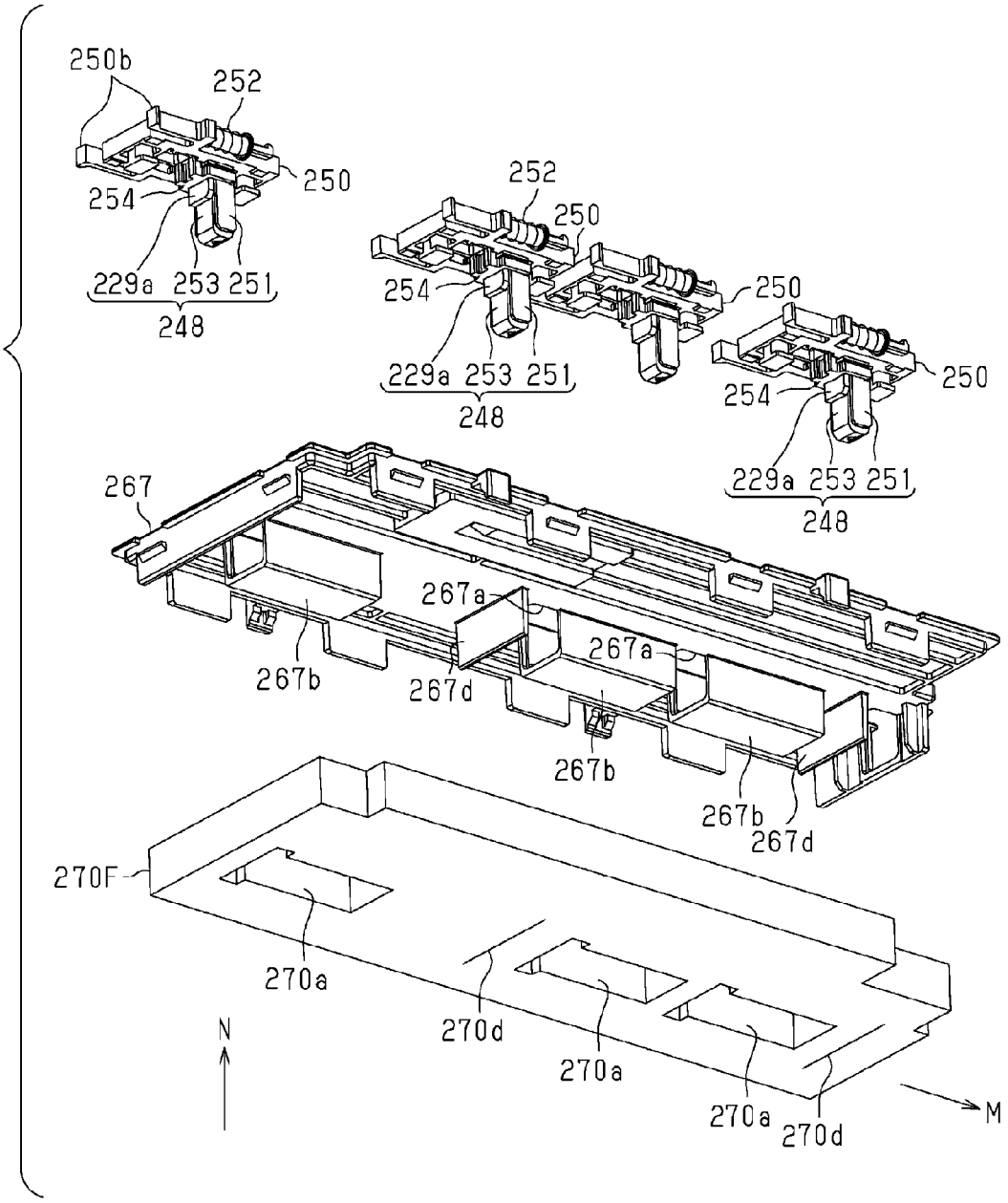
FIG. 17 is an exploded perspective view showing a configuration of a waste liquid transfer portion and a waste liquid inlet.

Referring to FIG. 17, insertion projections 267*d* that can be respectively inserted in the cut lines 270*d* of the first absorber 270F may be formed on the lid 267, and the lid 267 may be attached with the insertion projections 267*d* inserted in the cut lines 270*d*, in which case the shielding sheet 271 and the first absorber 270F can be prevented from being displaced. In addition, forming protruding portions 267*b* on the lid 267 in a box shape so as to respectively fit in the through holes 270*a* of the first absorber 270F and with an opening oriented in the release direction further assures that the first absorber 270F is prevented from being displaced. In FIG. 17, the main body of the sheet 229, the support member 227, and the storage frame 228 are not illustrated.

When the waste liquid reservoir 260 enters the mounting chamber 241 by moving in the insertion direction N as indicated by dash-dot-dot lines in FIG. 18, the waste liquid transfer portion 248 projecting into the mounting chamber 241 enters the box-shaped protruding portion 267*b* formed in the waste liquid reservoir 260. Then when the waste liquid reservoir 260 moves in the connection direction M inside the mounting chamber 241 and reaches the position indicated by solid lines in FIG. 18, the waste liquid transfer portion 248 comes out through the opening of the protruding portion 267*b* and enters the waste liquid inlet 267*a*, thus to contact the first absorber 270F.

In other words, the first absorber 270F enters into contact with the waste liquid transfer portion 248 as result of the movement in the connection direction M inside the mounting chamber 241. Accordingly, when the waste liquid receiving portion 230 receives the liquid ejected by the liquid ejecting head 231 as waste liquid, the ejected waste liquid emigrates along the waste liquid transfer portion 248 and is stored in the waste liquid reservoir 260.

In addition, when the waste liquid reservoir 260 moves in the connection direction M inside the mounting chamber 241, the waste liquid introduction port 281 is connected to the discharge unit 242. In other words, the waste liquid introduction port 281 is connected to the discharge unit 242 as result of the movement of the waste liquid reservoir 260 in the connection direction M inside the mounting chamber 241. Here, a cutaway portion 270*f* may be formed in the second absorber 270S constituting the lower layer, to secure a space around and under the discharge unit 242 for the waste liquid to flow through, when the discharge unit 242 is inserted into the waste liquid storage container 261.

Figure 19:
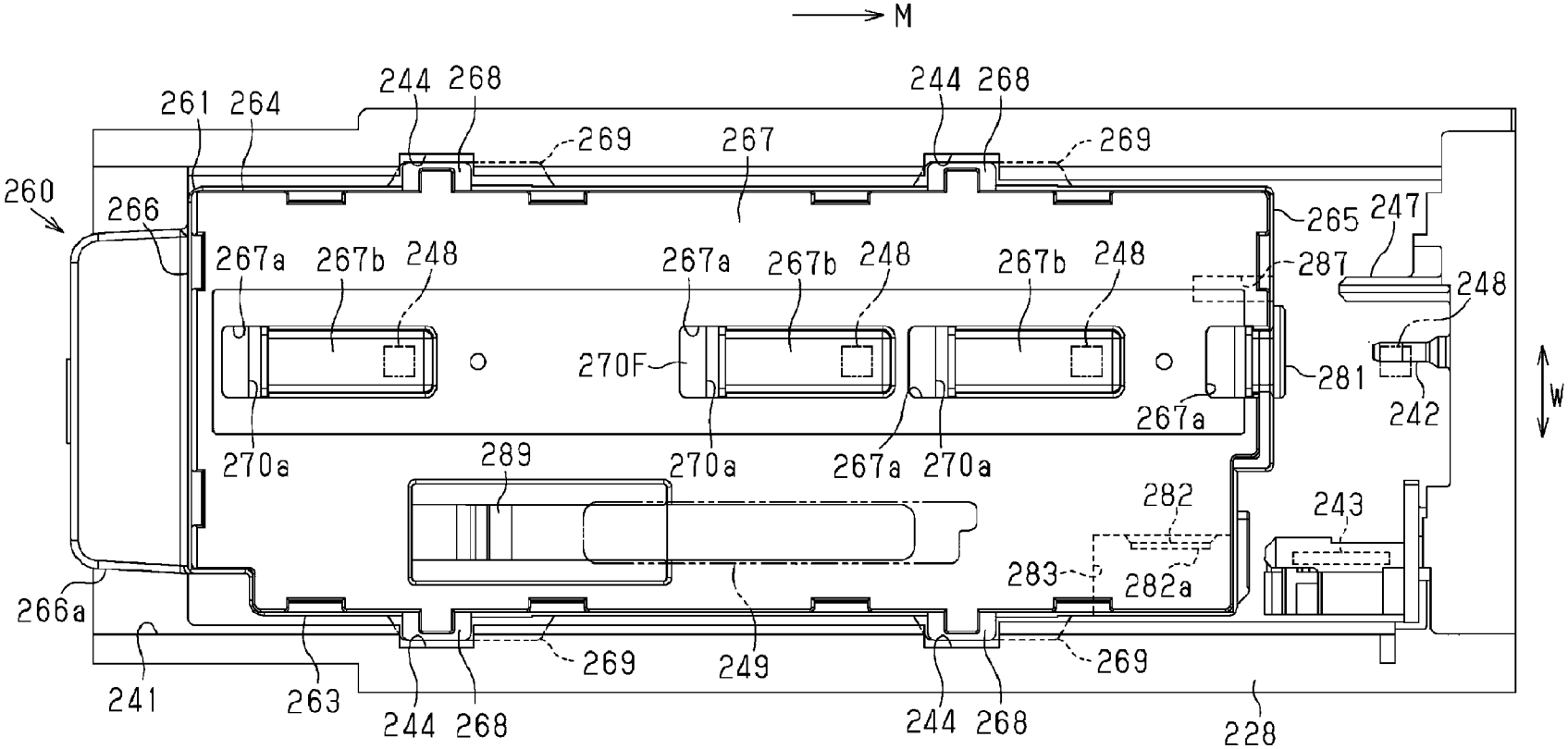
FIG. 19 is a plan view of a mounting chamber and the waste liquid reservoir.

Referring to FIG. 19, the circuit board 282 having the connection terminal 282*a* is located inside the recess 283 formed in the sidewall 263 of the waste liquid storage container 261 extending in the connection direction M, and is electrically connected to the substrate connection unit 243 as result of the movement in the connection direction M inside the mounting chamber 241. Because of such connection, the information about the waste liquid is transmitted and received between the circuit board 282 and the control unit 100 (see FIG. 9).

It is preferable that the waste liquid storage container 261 includes an engaging portion 289 to be engaged with the detent portion 249 when the waste liquid reservoir 260 moves in the connection direction M inside the mounting chamber 241. The engaging portion 289 is, for example, composed of a protruding portion and a recessed portion formed in the lid 267 constituting the ceiling of the waste liquid storage chamber 261*a* (see also FIG. 20).

Figure 20:
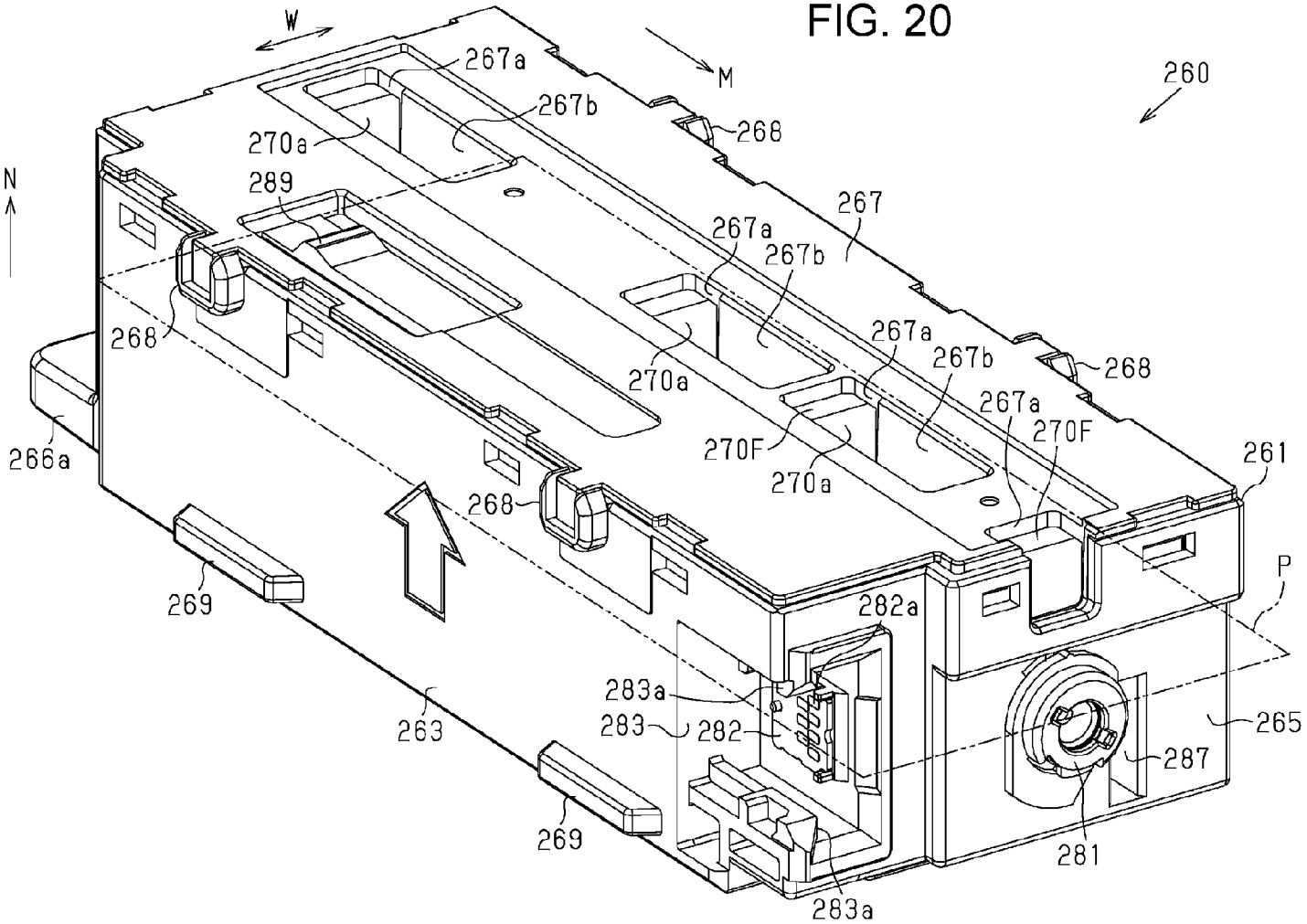
FIG. 20 is a perspective view showing the waste liquid reservoir shown in FIG. 13.

It is preferable that the waste liquid storage container 261 includes a fitting portion 287 to be engaged with the guide projection 247 when the waste liquid reservoir 260 moves in the connection direction M (see also FIG. 20). Although the fitting portion 287 according to this embodiment is a recessed portion formed in the front wall 265, a recessed portion, a protruding portion, or a flat portion formed on the bottom plate 262, the sidewalls 263 and 264, or the lid 267 may instead be employed as the fitting portion 287.

In the waste liquid storage container 261, it is preferable that the waste liquid introduction port 281 is located between the fitting portion 287 and the engaging portion 289 in a width direction W aligned with the direction in which the bottom plate 262 and the front wall 265 extend.

Figure 21:
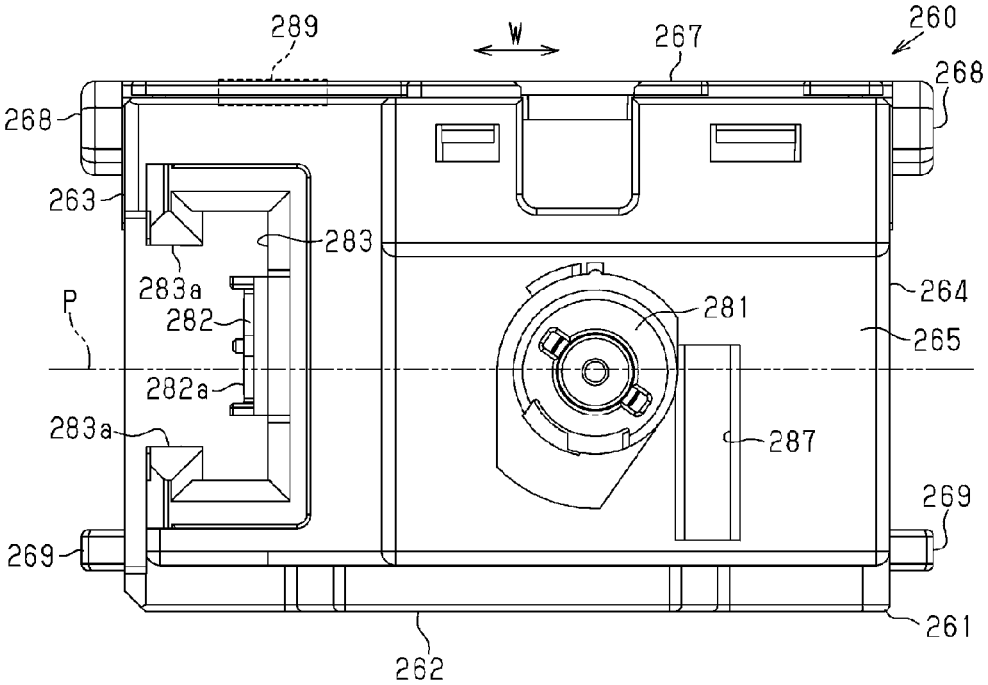
FIG. 21 is a front view of the waste liquid reservoir shown in FIG. 13.

Referring to FIG. 20 and FIG. 21, it is preferable that, in the waste liquid storage container 261, the waste liquid introduction port 281, the connection terminal 282*a*, and the fitting portion 287 are located so as to overlap an imaginary plane P extending parallel to the bottom plate 262. In other words, when the direction from the bottom plate 262 toward the lid 267 is referred to as height direction, it is preferable to locate the waste liquid introduction port 281, the connection terminal 282*a*, and the fitting portion 287 at the generally same height, and such that the waste liquid introduction port 281, the connection terminal 282*a*, and the fitting portion 287 are aligned in the width direction W in a front view as illustrated in FIG. 21.

In particular, when the guide projection 247 (see FIG. 19) is engaged with the fitting portion 287 which is recessed, via the upper end of the fitting portion 287, the position of the waste liquid reservoir 260 in the height direction is determined by the engagement between the guide projection 247 and the fitting portion 287. Therefore, the position of the waste liquid introduction port 281 and the connection terminal 282*a* can be correctly determined when the waste liquid reservoir 260 is mounted.

In addition, locating the connection terminal 282*a* between the bottom plate 262 and the engaging portion 289 in the waste liquid storage container 261 as shown in FIG. 21 is desirable, because the connection terminal 282*a* can be more accurately positioned in the height direction.

Figure 22:
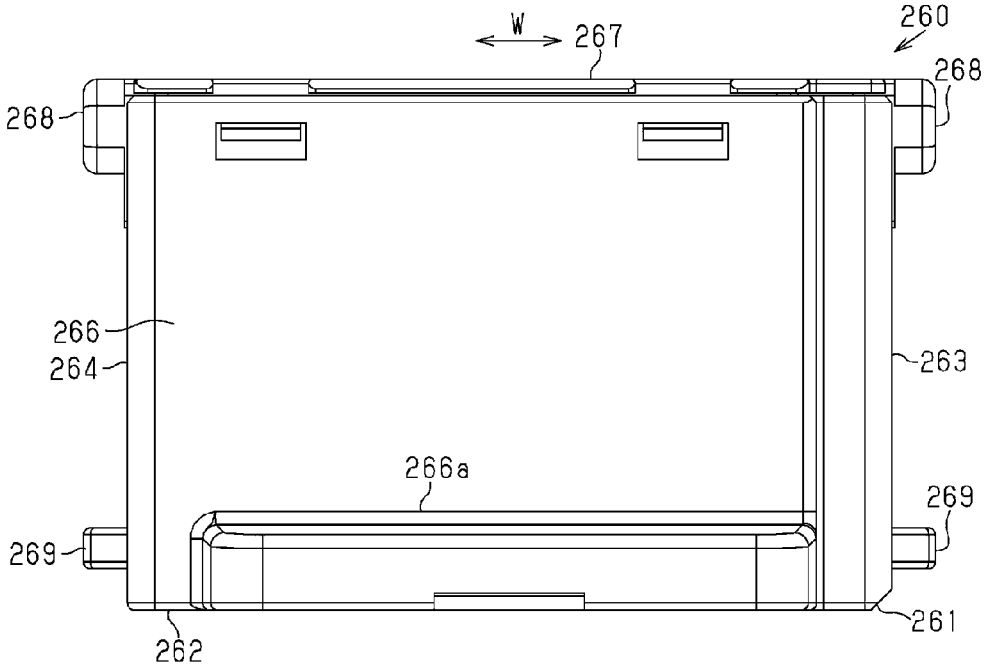
FIG. 22 is a rear view of the waste liquid reservoir shown in FIG. 13.

It is preferable to form the handle 266*a* so as to project from the rear wall 266 and to extend from the bottom plate 262 in the release direction, as shown in FIG. 22. Such a configuration stabilizes the waste liquid reservoir 260 when the waste liquid reservoir 260 is mounted with the bottom plate 262 oriented downward, and therefore the waste liquid can be prevented from leaking through the waste liquid inlet 267*a* opened in the lid 267 and the waste liquid introduction port 281 opened in the front wall 265, when the waste liquid reservoir 260 is taken out with the waste liquid stored therein. Further, locating the handle 266*a* in the vicinity of the bottom plate 262 allows the top side (the side of the lid 267) without the handle 266*a* and the bottom side (the side of the bottom plate 262) with the handle 266*a* to be easily distinguished.

Further, forming a stepped portion 241*a* in the mounting chamber 241 as shown in FIG. 9, FIG. 10, and FIG. 18 prevents the waste liquid reservoir 260 from being mounted in the mounting chamber 241 in a wrong posture, because when the waste liquid reservoir 260 is turned upside down the stepped portion 241*a* interferes with the handle 266*a*.

The waste liquid reservoir 260 and the liquid ejecting apparatus 211 configured as above provide the following advantageous effects.

In the waste liquid reservoir 260, the shielding sheet 271 partitioning the waste liquid storage chamber 261*a* prevents the sucked waste liquid from being absorbed by the first absorber 270F of the upper layer, thereby allowing the sucked waste liquid to be primarily absorbed by the second absorber 270S of the lower layer. The shielding sheet 271 also prevents the first absorber 270F from sinking because of the self-weight, thereby allowing a sufficient contact area between the waste liquid transfer portion 248 and the first absorber 270F to be stably secured.

In the liquid ejecting apparatus 211, the mounting chamber 241 in which the waste liquid reservoir 260 is mounted is open toward the bottom face side of the casing 212, and therefore when the waste liquid reservoir 260 is mounted or removed, the casing 212 is turned upside down. Since the waste liquid inlet 267*a* and the waste liquid introduction port 281 are open in the waste liquid reservoir 260, when the casing 212 is turned upside down with the waste liquid reservoir 260 mounted therein, the waste liquid inlet 267*a* or the waste liquid introduction port 281 may be oriented downward (or obliquely downward). However, the waste liquid stored in the waste liquid reservoir 260 is absorbed by the absorber 270, and therefore the waste liquid is prevented from leaking through the waste liquid inlet 267*a* and the waste liquid introduction port 281.

Here, a plurality of waste liquid inlets 267*a* are provided, and each of the waste liquid inlets 267*a* has to have a sufficiently large opening space to allow the waste liquid introduction port 281 to pass therethrough, which facilitates the waste liquid to leak. In this embodiment, however, the recess (through hole 270*a*) through which the waste liquid introduction port 281 passes is covered with the box-shaped protruding portion 267*b*, and therefore the opening space of the waste liquid inlets 267*a* can be reduced, so that the leakage of the waste liquid is prevented.

In the waste liquid reservoir 260, the ejected waste liquid received by the waste liquid receiving portion 230 is transferred along the waste liquid transfer portion 248 and absorbed by the first absorber 270F located in contact with the waste liquid transfer portion 248. Therefore, the waste liquid can be prevented from splashing around in the mounting chamber 241. As result, the waste liquid barely sticks to the connection terminal 282*a* and the inner wall of the mounting chamber 241. In addition, since the circuit board 282 is accommodated inside the recess 283, the waste liquid can be prevented from sticking to the connection terminal 282*a* even though the waste liquid that has leaked drops along the sidewall 263.

When the slider 250 is biased in the release direction by the biasing member 252, the waste liquid transfer portion 248 is pressed against the first absorber 270F of the waste liquid reservoir 260 moving in the connection direction M inside the mounting chamber 241. Therefore, the contact between the waste liquid transfer portion 248 and the first absorber 270F can be assured.

The waste liquid reservoir 260 which has moved in the connection direction M inside the mounting chamber 241 is detained in the liquid ejecting apparatus 211 by the engagement between the detent portion 249 and the engaging portion 289. In the case where the mounting chamber 241 possesses a large space in the width direction W the waste liquid reservoir 260 may tilt about the engaging portion 289. However, the engagement between the fitting portion 287 and the guide projection 247 suppresses the waste liquid reservoir 260 from tilting.

In addition, locating the waste liquid introduction port 281 between the fitting portion 287 and the engaging portion 289 in the width direction W suppresses the displacement of the waste liquid introduction port 281 originating from the tilting of the waste liquid reservoir 260. Therefore, the leakage of the waste liquid can be prevented while maintaining the connection between the waste liquid introduction port 281 and the discharge unit 242. Further, locating the connection terminal 282*a* between the bottom plate 262 and the engaging portion 289 suppresses the displacement of the connection terminal 282*a* originating from the tilting of the waste liquid reservoir 260, and therefore the connection between the connection terminal 282*a* and the substrate connection unit 243 can be maintained.

The foregoing embodiment provides the following advantageous effects.

Removably mounting the waste liquid reservoir 260 in the liquid ejecting apparatus 211 allows the space for storing the waste liquid (mounting chamber 241) to be reduced, compared with the case of providing a fixed waste liquid storage device which is unable to be replaced in the casing 212. Accordingly, the liquid ejecting apparatus 211 can be made smaller in size.

However, when the waste liquid reservoir 260 is replaceable, the waste liquid reservoir 260 may be removed and mounted halfway of the use, which makes the waste liquid more likely to stick to the connection terminal 282*a*. Further, although providing the waste liquid inlet 267*a* and the waste liquid introduction port 281 in the waste liquid reservoir 260 allows both of the ejected waste liquid and the sucked waste liquid to be collected, the risk of the waste liquid leakage is increased, by providing two openings (for the waste liquid inlet 267*a* and the waste liquid introduction port 281) for introducing the waste liquid, in the waste liquid reservoir 260.

However, the connection terminal 282*a* of the circuit board 282 is located on the sidewall 263, which is different from the lid 267 including the waste liquid inlet 267*a* and the front wall 265 including the waste liquid introduction port 281, and therefore the waste liquid barely sticks to the connection terminal 282*a*.

The foregoing embodiment may be modified as variations provided hereunder. The configuration according to the embodiment and the configuration according to the variations may be combined as desired, and also the configurations according to the variation may be combined.

When the sheet 229 is not placed in the receiving recess 227*b*, the waste liquid transfer portion 248, the slider 250, the absorption sheet 253, the auxiliary member 254, and the protruding portion 267*b* may be excluded, so that the waste liquid drops into the waste liquid inlet 267*a* through the through hole 227*c*, 228*c*.

The waste liquid transfer portion 248 may be substituted with a different member disposed in contact with the sheet 229. For example, a member that transfers the liquid from the slider 250 may be provided so as to extend toward the top face side and to contact the sheet 29.

The liquid ejected by the liquid ejecting head 14 may be, without limitation to the ink, a liquid-phase material containing particles of a functional material dispersed or mixed therein. For example, a liquid-phase material containing, dispersed or dissolved therein, an electrode material or a color material (pixel material) employed for manufacturing a liquid crystal display, an electroluminescence (EL) display, or a field emission display may be ejected for recording.

The medium S is not limited to the paper sheet, but may instead be a plastic film, a thin plate material, or a fabric used with a printing machine.

The medium S may be transported with a lateral edge running along the home-side end, or with the center of the medium S aligned with the center of the transport route.

The liquid ejecting apparatus 11 may be a line-head printer having a line head including a plurality of liquid ejecting heads 14 aligned such that the printing range covers the entire width of the medium S. In this case, a cap capable of receiving the liquid and a medium support unit including a liquid receiving portion may be alternately moved to a region onto which the line head ejects the liquid, to receive the liquid.

The entire disclosure of Japanese Patent Application No. 2016-007093, filed Jan. 18, 2016 and Japanese Patent Application No. 2016-173390, filed Sep. 6, 2016 are expressly incorporated by reference herein.

What is claimed is:

1. A waste liquid reservoir to be removably mounted in a mounting chamber in a liquid ejecting apparatus that includes a liquid ejecting head that ejects liquid, a waste liquid receiving portion that receives the liquid ejected by the liquid ejecting head as waste liquid, a discharge unit that discharges the liquid discharged from the liquid ejecting head as waste liquid, a substrate connection unit, and the mounting chamber accommodating therein the discharge unit and the substrate connection unit, the waste liquid reservoir comprising:

a waste liquid storage container including a sidewall and a bottom plate defining a waste liquid storage chamber that stores the waste liquid, the waste liquid storage chamber including a waste liquid inlet, located in a ceiling portion of the waste liquid storage chamber and opened toward an insertion direction so as to allow the waste liquid received by the waste liquid receiving portion to be introduced, when the waste liquid reservoir enters the mounting chamber by being moved in the insertion direction;

a waste liquid introduction port to be connected to the discharge unit by being moved in the mounting chamber in a connection direction different from the insertion direction; and a circuit board including a connection terminal to be electrically connected to the substrate connection unit by being moved in the connection direction in the mounting chamber, wherein the waste liquid introduction port is located in a front wall of the waste liquid storage container intersecting the sidewall and the bottom plate, and the connection terminal is located in the sidewall of the waste liquid storage container different from the front wall and the ceiling portion.

2. The waste liquid reservoir according to claim 1, wherein the waste liquid storage container includes a plurality of the waste liquid inlets aligned in the connection direction.

3. The waste liquid reservoir according to claim 1, wherein the mounting chamber includes a detent portion that detains the waste liquid storage container, the waste liquid storage container includes an engaging portion to be engaged with the detent portion when the waste liquid reservoir moves in the connection direction in the mounting chamber, the engaging portion being located in the ceiling portion, and the connection terminal is located between the bottom plate and the engaging portion, in the waste liquid storage container.

4. The waste liquid reservoir according to claim 3, wherein the mounting chamber includes a guide projection projecting in the connection direction, the waste liquid storage container includes a fitting portion to be engaged with the guide projection when the waste liquid reservoir moves in the connection direction, and the waste liquid introduction port is located between the fitting portion and the engaging portion in a width direction that is an extending direction of the bottom plate and the front wall of the waste liquid storage container.

5. The waste liquid reservoir according to claim 1, wherein the mounting chamber includes a guide projection projecting in the connection direction, the waste liquid storage container includes a fitting portion to be engaged with the guide projection when the waste liquid reservoir moves in the connection direction, and the waste liquid introduction port, the connection terminal, and the fitting portion are located in the waste liquid storage container at positions overlapping an imaginary plane extending along the bottom plate.

6. The waste liquid reservoir according to claim 1, further comprising:

a waste liquid transfer portion extending from the waste liquid receiving portion and projecting into the mounting chamber; and an absorber capable of absorbing the waste liquid stored in the waste liquid storage chamber, wherein the absorber enters into contact with the waste liquid transfer portion by being moved in the connection direction in the mounting chamber.

7. A liquid ejecting apparatus comprising:

a liquid ejecting head that ejects liquid;

a waste liquid receiving portion that receives the liquid ejected by the liquid ejecting head as waste liquid;

a discharge unit that discharges the liquid discharged from the liquid ejecting head as waste liquid;

a substrate connection unit; and a mounting chamber accommodating therein the discharge unit and the substrate connection unit, wherein the waste liquid reservoir according to claim 1 is removably mounted in the mounting chamber.

* * * * *